US012550964B2

(12) United States Patent
Rogers

(10) Patent No.: US 12,550,964 B2
(45) Date of Patent: Feb. 17, 2026

(54) HELMET HAVING VISOR PIVOTING AND LOCKING MECHANISM AND ASSOCIATED SYSTEM AND METHODS

(71) Applicant: Final Forge, LLC, Blountville, TN (US)

(72) Inventor: David Rogers, Blountville, TN (US)

(73) Assignee: Final Forge, LLC, Blountville, TN (US)

( * ) Notice: Subject to any disclaimer, the term of this patent is extended or adjusted under 35 U.S.C. 154(b) by 0 days.

(21) Appl. No.: 18/647,620

(22) Filed: Apr. 26, 2024

(65) Prior Publication Data

US 2025/0000195 A1 Jan. 2, 2025

Related U.S. Application Data

(60) Provisional application No. 63/498,521, filed on Apr. 27, 2023.

(51) Int. Cl.
*A42B 3/22* (2006.01)
*A42B 3/18* (2006.01)

(52) U.S. Cl.
CPC ..... *A42B 3/223* (2013.01); *A42B 3/18* (2013.01); *A42B 3/22* (2013.01); *A42B 3/221* (2013.01)

(58) Field of Classification Search
CPC .. A42B 3/223; A42B 3/18; A42B 3/22; A42B 3/221
See application file for complete search history.

(56) References Cited

U.S. PATENT DOCUMENTS

| | | | | |
|---|---|---|---|---|
| 2,763,863 A | | 9/1956 | Bowers, Sr. | |
| 2,967,304 A | | 1/1961 | Austin | |
| 3,066,305 A | | 12/1962 | Alleo | |
| 3,253,281 A | | 5/1966 | Benner | |
| 3,310,811 A | * | 3/1967 | Iacono, Jr. | A42B 3/08 128/201.24 |
| 3,400,407 A | * | 9/1968 | Aileo | A42B 3/221 2/427 |
| 3,495,273 A | | 2/1970 | Aileo | |
| 3,510,879 A | | 5/1970 | Webb | |
| 3,568,211 A | | 3/1971 | Petruzella, Jr. | |

(Continued)

FOREIGN PATENT DOCUMENTS

| | | |
|---|---|---|
| CA | 2017401 A1 | 3/1991 |
| CA | 2611265 A1 | 5/2009 |

(Continued)

OTHER PUBLICATIONS

Gentex Corporation, Gentex HGU-56/P Rotary Wing Helmet System; https://shop.gentexcorp.com/gentex-hgu-56-p-rotary-wing-helmet-system/.

*Primary Examiner* — Khaled Annis
(74) *Attorney, Agent, or Firm* — Widerman Malek, PL; Mark Malek

(57) ABSTRACT

A helmet visor system may include a helmet shaped to accommodate a headset, a visor lens and a visor apparatus to pivotally move the visor lens between a stored position and a deployed position. The deployed position may be defined as a majority of the visor lens being extended from the helmet, and the stored position may be defined as the majority of the visor lens being occluded by the helmet within an interior of the helmet. The visor lens may be pivotally moveable between the stored position and the deployed position so as not to interfere with the headset.

30 Claims, 27 Drawing Sheets

(56) References Cited

U.S. PATENT DOCUMENTS

| | | | | | |
|---|---|---|---|---|---|
| 3,585,638 | A * | 6/1971 | Aileo | A42B 3/228 | 2/6.4 |
| 3,601,813 | A * | 8/1971 | Aileo | A42B 3/228 | 2/6.4 |
| 3,748,657 | A * | 7/1973 | Aileo | A42B 3/226 | 2/6.4 |
| 3,897,596 | A | 8/1975 | Aileo et al. | | |
| 3,992,720 | A | 11/1976 | Nicolinas | | |
| 4,023,209 | A | 5/1977 | Frieder, Jr. et al. | | |
| 4,170,042 | A * | 10/1979 | Aileo | A42B 3/228 | 2/424 |
| 4,354,283 | A | 10/1982 | Gooding | | |
| 4,621,377 | A * | 11/1986 | Pennell | A42B 3/223 | 2/10 |
| 4,887,320 | A * | 12/1989 | Long | A42B 3/226 | 2/424 |
| 4,888,831 | A | 12/1989 | Oleson | | |
| 4,918,752 | A * | 4/1990 | Briggs | A42B 3/042 | 2/6.2 |
| 5,177,816 | A | 1/1993 | Schmidt et al. | | |
| 5,337,420 | A | 8/1994 | Haysom et al. | | |
| 5,467,480 | A * | 11/1995 | Baudou | A42B 3/222 | 2/424 |
| 5,572,749 | A | 11/1996 | Ogden | | |
| 5,987,651 | A * | 11/1999 | Tanaka | A42B 3/223 | 2/424 |
| 6,081,931 | A | 7/2000 | Burns et al. | | |
| 8,348,448 | B2 | 1/2013 | Orozco et al. | | |
| 8,505,121 | B2 | 8/2013 | Ahlgren et al. | | |
| 8,661,570 | B2 | 3/2014 | Huh | | |
| 8,745,770 | B2 | 6/2014 | Ahlgren et al. | | |
| 8,875,318 | B2 | 11/2014 | Huh | | |
| 9,066,551 | B2 | 6/2015 | Van Waes | | |
| 9,066,552 | B2 | 6/2015 | Ahlgren et al. | | |
| 9,179,729 | B2 | 11/2015 | Cotterman et al. | | |
| 9,307,800 | B2 | 4/2016 | Andrews et al. | | |
| 9,307,802 | B2 | 4/2016 | Hall | | |
| 9,314,060 | B2 | 4/2016 | Giles | | |
| 9,357,811 | B2 | 6/2016 | Chiang | | |
| 9,480,293 | B2 | 11/2016 | Pfanner et al. | | |
| 9,494,388 | B2 | 11/2016 | Crye et al. | | |
| 9,788,592 | B2 * | 10/2017 | Cheng | A42B 3/222 | |
| 9,907,348 | B2 | 3/2018 | Huh | | |
| 10,016,008 | B2 | 7/2018 | Sommers et al. | | |
| 10,034,510 | B2 | 7/2018 | Patel et al. | | |
| 10,064,443 | B2 | 9/2018 | Hall | | |
| 10,098,403 | B2 | 10/2018 | Sommers et al. | | |
| 10,299,530 | B2 | 5/2019 | Patel et al. | | |
| 10,441,019 | B2 | 10/2019 | Huh | | |
| 10,588,373 | B2 | 3/2020 | Staudinger | | |
| 10,588,374 | B2 | 3/2020 | Maloney | | |
| 10,743,600 | B2 | 8/2020 | Cleveland et al. | | |
| 10,842,217 | B2 | 11/2020 | Smallwood | | |
| 11,357,279 | B2 | 6/2022 | Cotterman | | |
| 11,937,659 | B2 * | 3/2024 | Lübke | A42B 3/225 | |
| 2001/0022005 | A1 | 9/2001 | Sasaki et al. | | |
| 2006/0015986 | A1 | 1/2006 | Bielefeld | | |
| 2007/0261153 | A1 | 11/2007 | Wise et al. | | |
| 2008/0028501 | A1 * | 2/2008 | Schimpf | A42B 3/226 | 2/424 |
| 2009/0229041 | A1 | 9/2009 | Tufenkjian | | |
| 2010/0024097 | A1 | 2/2010 | Saenim | | |
| 2011/0289659 | A1 | 12/2011 | Lanez et al. | | |
| 2013/0219596 | A1 | 8/2013 | Carvell | | |
| 2014/0317834 | A1 * | 10/2014 | Power | A42B 3/221 | 2/424 |
| 2015/0059066 | A1 | 3/2015 | Ketterer et al. | | |
| 2016/0000170 | A1 | 1/2016 | Simons | | |
| 2017/0238643 | A1 | 8/2017 | Pereira et al. | | |
| 2017/0245578 | A1 | 8/2017 | Xiong et al. | | |
| 2017/0367430 | A1 | 12/2017 | Javorek et al. | | |
| 2018/0042330 | A1 | 2/2018 | Wu | | |
| 2018/0042774 | A1 | 2/2018 | Wu | | |
| 2018/0271199 | A1 | 9/2018 | Szalkowski et al. | | |
| 2018/0338559 | A1 | 11/2018 | Plunkett et al. | | |
| 2019/0029355 | A1 | 1/2019 | Seo et al. | | |
| 2019/0339736 | A1 | 11/2019 | Chang et al. | | |
| 2020/0060544 | A1 | 2/2020 | Ross | | |
| 2020/0383416 | A1 | 12/2020 | Miller et al. | | |
| 2020/0390182 | A1 | 12/2020 | Huh et al. | | |
| 2022/0361620 | A1 * | 11/2022 | Lu | A42B 3/221 | |
| 2024/0285019 | A1 * | 8/2024 | Reitebuch | A61F 9/029 | |
| 2025/0000195 | A1 * | 1/2025 | Rogers | A42B 3/223 | |

FOREIGN PATENT DOCUMENTS

| | | | |
|---|---|---|---|
| CA | 2767266 | C | 8/2013 |
| CN | 109380799 | A | 2/2019 |
| EP | 2937005 | A2 | 10/2015 |
| FR | 2983688 | A1 | 6/2013 |
| FR | 3060972 | A1 | 6/2018 |
| GB | 894251 | A | 4/1962 |
| JP | 5733858 | B2 | 6/2015 |
| KR | 101150518 | B1 | 5/2012 |
| KR | 101674630 | B1 | 11/2016 |
| KR | 101961435 | B1 | 3/2019 |
| RU | 194740 | U1 | 12/2019 |
| WO | 2012071802 | A1 | 6/2012 |
| WO | 2017018118 | A1 | 6/2017 |

* cited by examiner

HELMET HAVING VISOR PIVOTING AND LOCKING MECHANISM AND ASSOCIATED SYSTEM AND METHODS

RELATED APPLICATIONS

This application claims priority under 35 U.S.C. § 119(e) of U.S. Provisional Patent Application Ser. No. 63/498,521 filed on Apr. 27, 2023 and titled HELMET HAVING VISOR PIVOTING AND LOCKING MECHANISM AND ASSOCIATED SYSTEM AND METHODS. The content of this application is incorporated herein by reference in its entirety.

FIELD OF THE INVENTION

The present invention relates to the field of helmets that can be used for any number of purposes and, more specifically, to helmets that can be used with a visor that is moveable between a stored position and a deployed position.

BACKGROUND OF THE INVENTION

In general, helmets themselves are well known in the art and have been a part of personal protection equipment for the vast majority, if not all, of recorded history to provide protection to the head in a variety of situations. Helmets have been used extensively by workers, hobbyists, law enforcement, soldiers, pilots, and many others for numerous applications with the primary function of these helmets to safeguard the wearer from potential hazards or injury.

In the realm of aviation, law enforcement, or the military, helmets often incorporate additional features and tools such as optics, flashlights, storage, visors. Visors often serve to cover or shield the wearer's eyes from a number of environmental conditions, including glare or flying debris or can incorporate certain technologies to provide a wearer with a number of different viewing capabilities or displayed information. However, the prior art have failed to provide certain functionalities of helmets, and of visor helmets that create a need for improvement. For instance, and without limitation, a few failures of the prior art include the helmets being limited to visors only being deployable via sliding movements with the helmet, the visors do not allow for non-helmet-integrated headsets or headphones to be worn with a visored helmet.

In the prior art, the adjustment of the visor height is often achieved through the use of hand-screws, such as clicking hand-screws. This requires fine motor skills and is often time-consuming, especially in situations that call for fast action. Also, the hand-screws can be difficult to operate with gloves on or in cold weather conditions. Moreover, the clicking mechanisms of hand-screws quickly wear out over time due to normal wear and tear, leading to less precise adjustments or total failure of the visor. Additionally, the hand-screws are often uncomfortable to use and can even be painful to use after prolonged operation of the hand-screws.

Sliding visors of the prior art frequently malfunction due to debris being present on the visor, and also are often unable to be quickly deployed since they require a pull force on the sliding visor which is in a specific correct direction directed away from the helmet. Sliding visors often also include a high coefficient of friction in order to hold the sliding visor at a selected position of a wearer, which often prevents fast deployment of the sliding visor from the helmet, which is largely an issue and undesirable, especially in time sensitive scenarios.

One example of a prior art helmet is offered by Gentex® under model number HGU-56/P. This helmet does not allow for the visor to be carried inside the helmet body, i.e., the visor is positioned exterior to the protective helmet shell under a non-structural cover when in the stored position to keep it from getting scratched when not in use. This extra visor cover adds weight, bulk, and cost to this helmet. Further, the Gentex® HGU-56/P helmet does not allow for use in connection with a separate independent headset and can only use headphones built into the helmet. As is the case with most prior art helmets that attempt to incorporate retractable visors, a significant issue arises with the path of travel of the visors with respect to their use in conjunction with headsets. As such, the prior art solutions are either forced to position the visors external to the helmet shell, and/or use sliding track mechanisms (as opposed to pivot mechanisms) to store and deploy the visors.

Therefore, there is a need for a system and/or method that solves at least one of the above issues left by the prior art.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

With the above in mind, embodiments of the present invention are related to a helmet visor system that includes a helmet shaped to accommodate a headset. The helmet may also include a helmet interior and a helmet exterior. The system may further include a visor lens that may be retractably carried by the helmet, and a visor apparatus carried by the helmet. The visor apparatus may be connected to the visor lens to pivotally move the visor lens between a stored position and a deployed position. The deployed position of the visor lens may be defined as a majority of the visor lens being extended from the helmet. The stored position of the visor lens may be defined as the majority of the visor lens being occluded by the helmet. The visor lens may be pivotally moveable between the stored position and the deployed position so as not to interfere with the headset. The visor lens being occluded by the helmet may be defined as the visor lens being positioned within the helmet interior.

The system may also include a first visor carrier and a second visor carrier. Each of the first visor carrier and the second visor carrier may have portions connected to the visor lens and portions pivotally connected to the helmet.

The system may further include an actuation knob that extends through a visor actuator slot and is attached to the first visor carrier. The actuation knob may be movable between an upper portion of the visor actuator slot and a lower portion of the visor actuator slot. The actuation knob may be moveable between an engaged position and a disengaged position when positioned in one or both of the upper portion and lower portion of visor actuator slot. When in the disengaged position, the actuation knob may be moveable between the upper portion and the lower portion of the visor actuator slot. When in the engaged position, the actuation knob may be fixed from movement between the upper portion and the lower portion of the visor actuator slot.

The actuation knob may be movable between a stored locked position and a deployed locked position. The stored locked position may be defined as when the actuation knob is moved to the upper portion of the visor actuator slot and in the engaged position. The deployed lock position may be defined as when the actuation knob is moved to the lower position of the visor actuator slot and in the engaged position.

The system may also include a knob lock spring to cause the actuation knob to move from the disengaged position to the engaged position. The system may further include a positioning hook rotatably attached to the helmet and moveable within the visor actuator slot.

An end portion of the positioning hook may define the lower portion of the visor actuator slot. The positioning hook may be moveable to a user selected position within the visor actuator slot to define the lower portion of the visor actuator slot.

The system may also include a pivot member that may be adapted to engage a pivot through hole formed in a side portion of the helmet. The pivot member may be connected to a portion of the positioning hook. The positioning hook may be rotatably moveable with respect to the pivot member.

The system may further include a lock screw that is adapted to engage the positioning hook and is moveable within a lock screw slot. The lock screw may be moveable between a fixed position and an unfixed position. The unfixed position of the lock screw may allow the positioning hook to be rotatably moved within the visor actuator slot. The fixed position may lock the position of the positioning hook within the visor actuator slot.

The first and the second visor carriers may each include a first lever and a second lever to removably connect the first and second visor carriers to the visor lens. Both the first and second levers may be movable between a locked state and an unlocked state.

BRIEF DESCRIPTION OF THE DRAWINGS

Some embodiments of the present invention are illustrated as an example and are not limited by the figures of the accompanying drawings, in which like references may indicate similar elements.

DETAILED DESCRIPTION OF THE INVENTION

Figure 1:
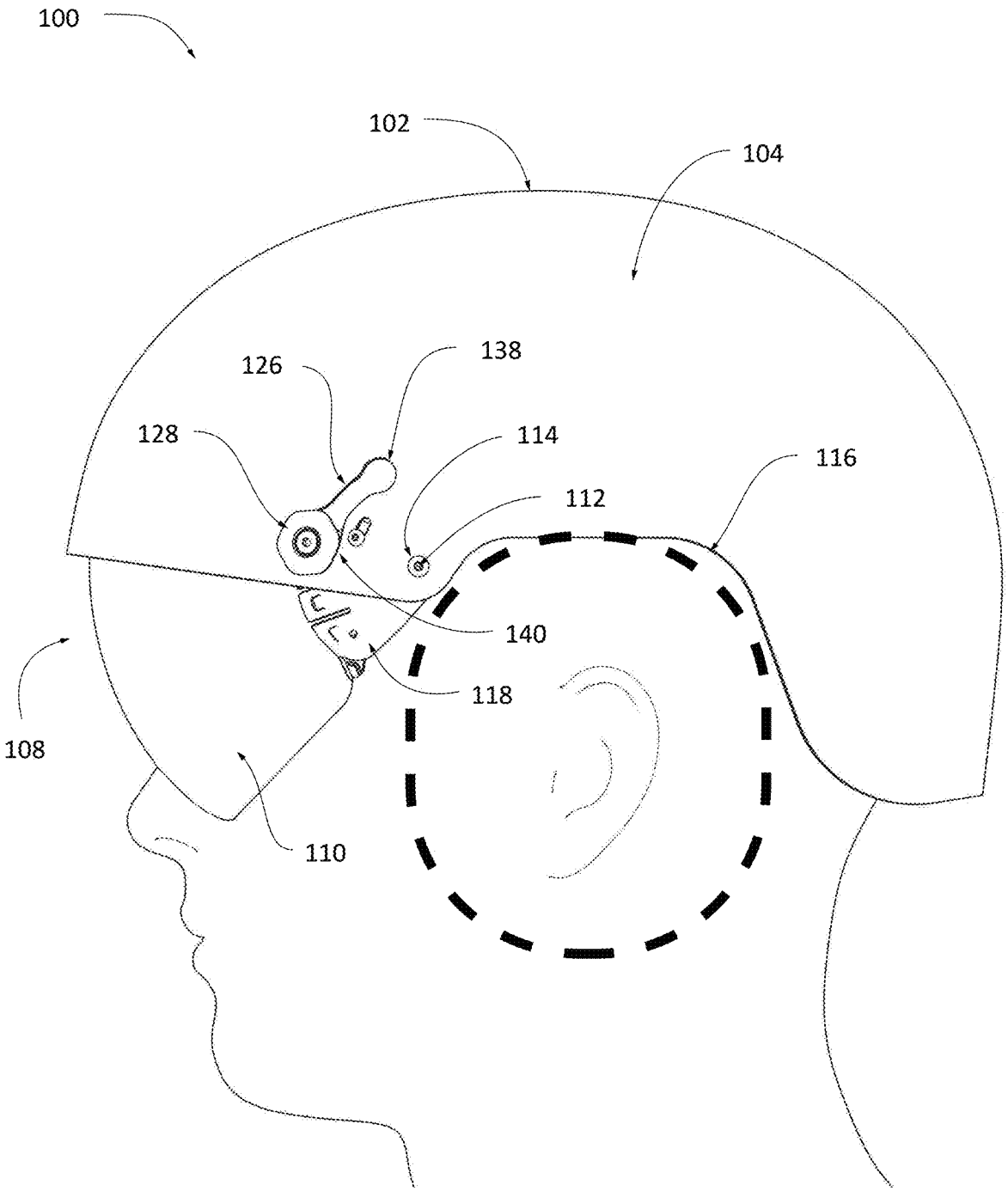
FIG. 1 is a side view of an adjustable helmet visor system according to an embodiment of the present invention installed in a helmet and being worn by a user, and showing a visor of the system in a deployed position.
Figure 2:
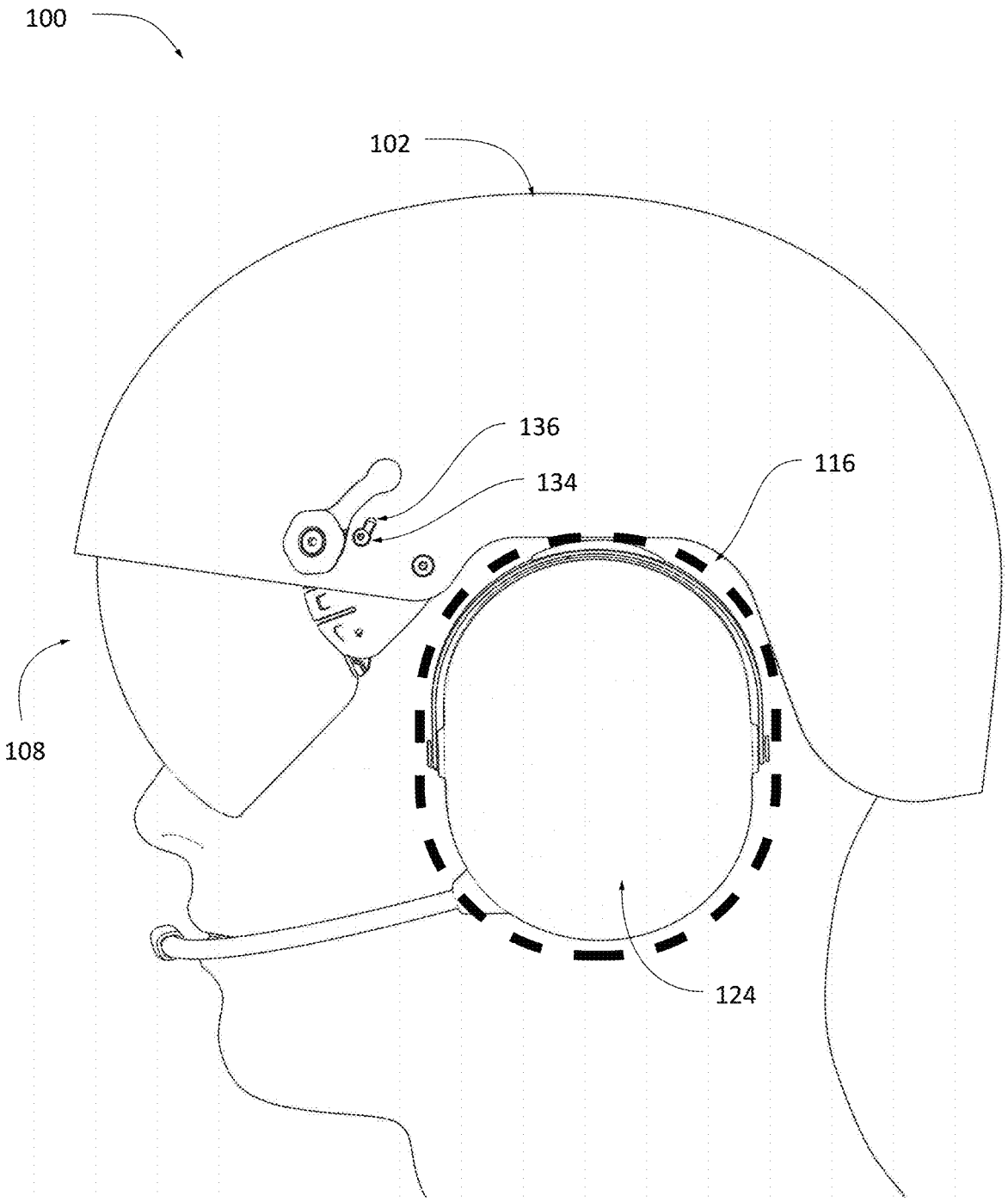
FIG. 2 is another side view of the system illustrated in FIG. 1, and showing a headset that is being worn by the user without conflicting with the helmet visor system.
Figure 3:
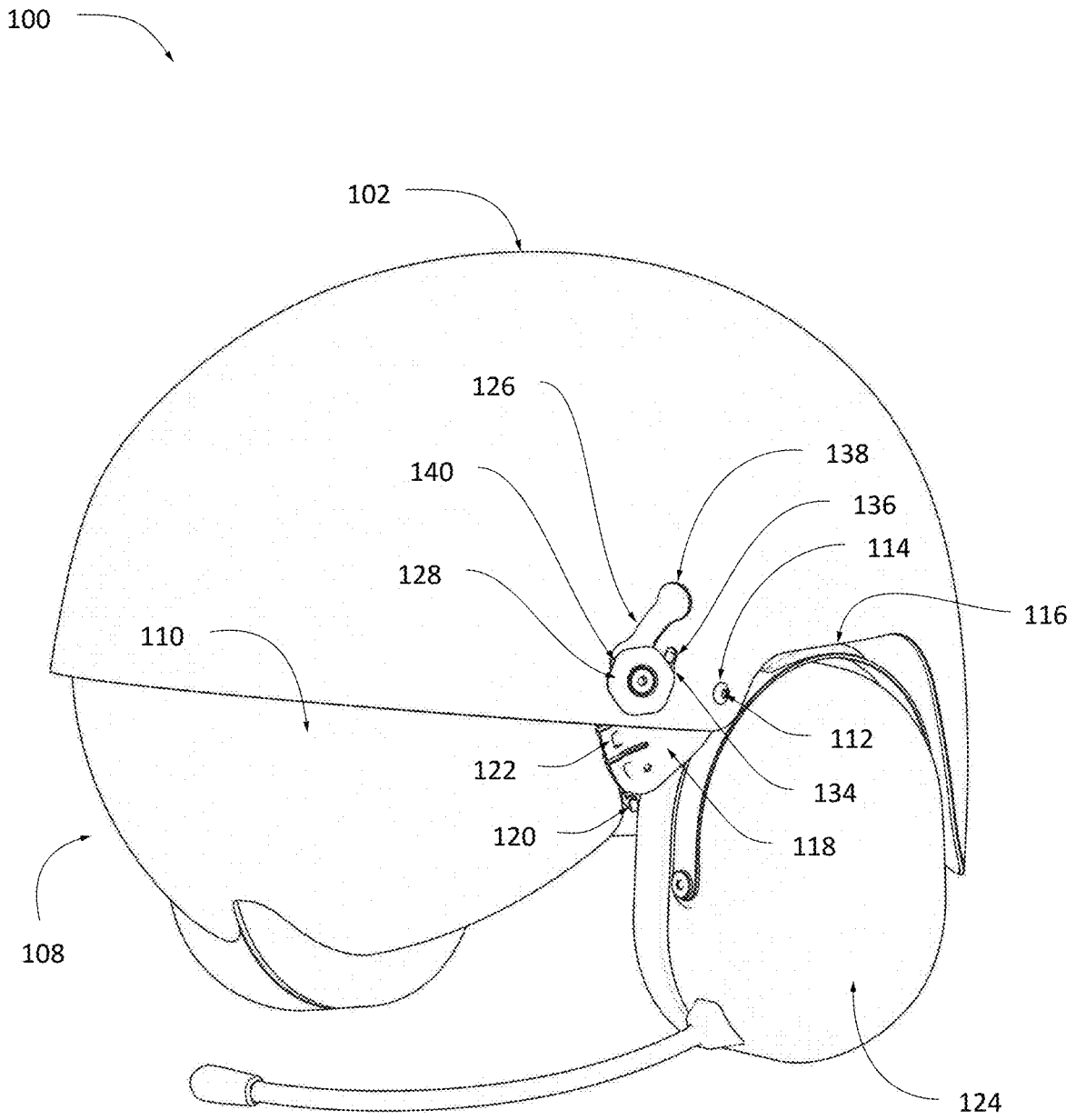
FIG. 3 is a perspective view of the system illustrated in FIG. 2, shown without a user wearing the helmet.
Figure 4:
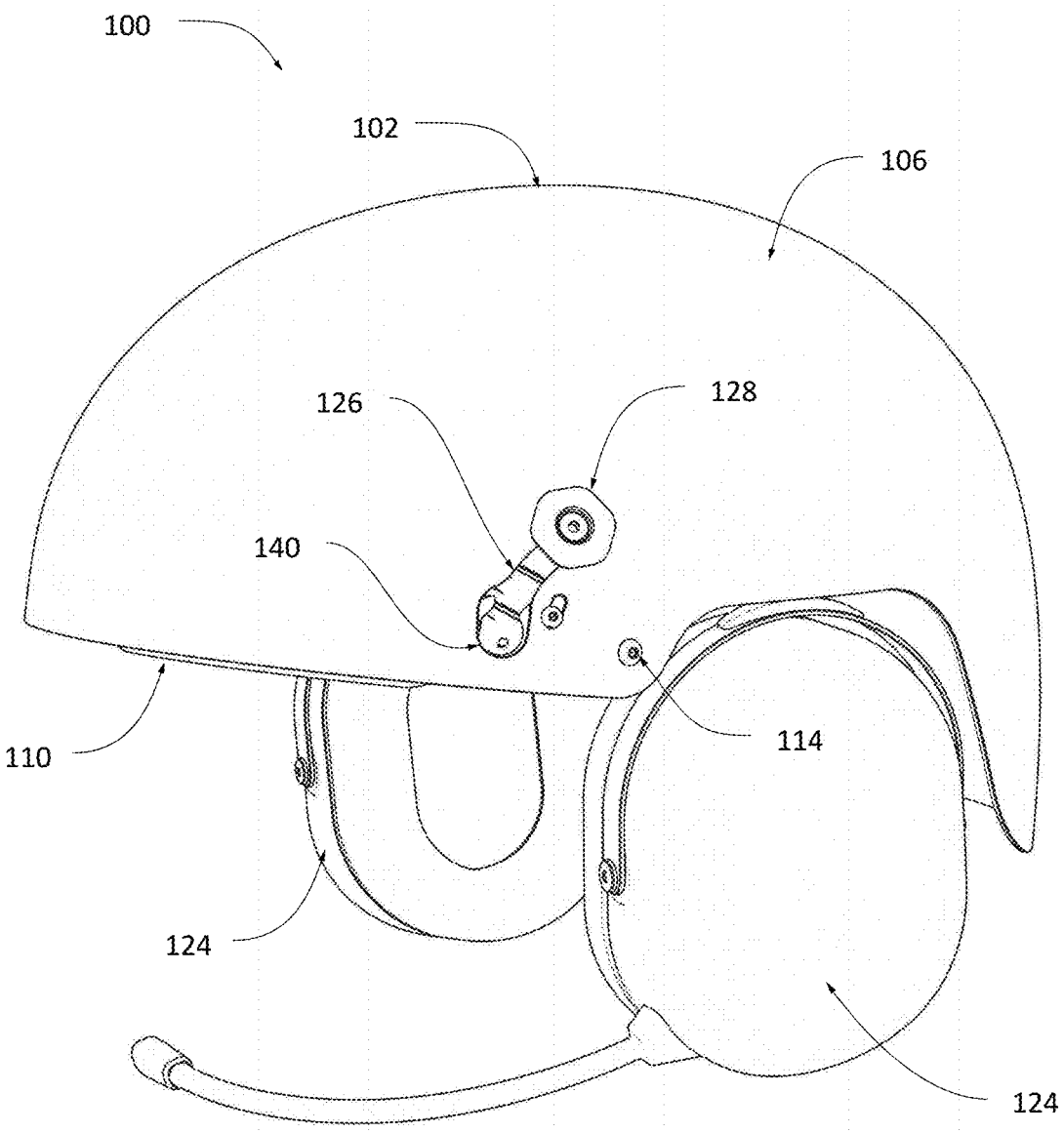
FIG. 4 is a perspective view of the system illustrated in FIG. 3, with the visor in the stored position.
Figure 5:
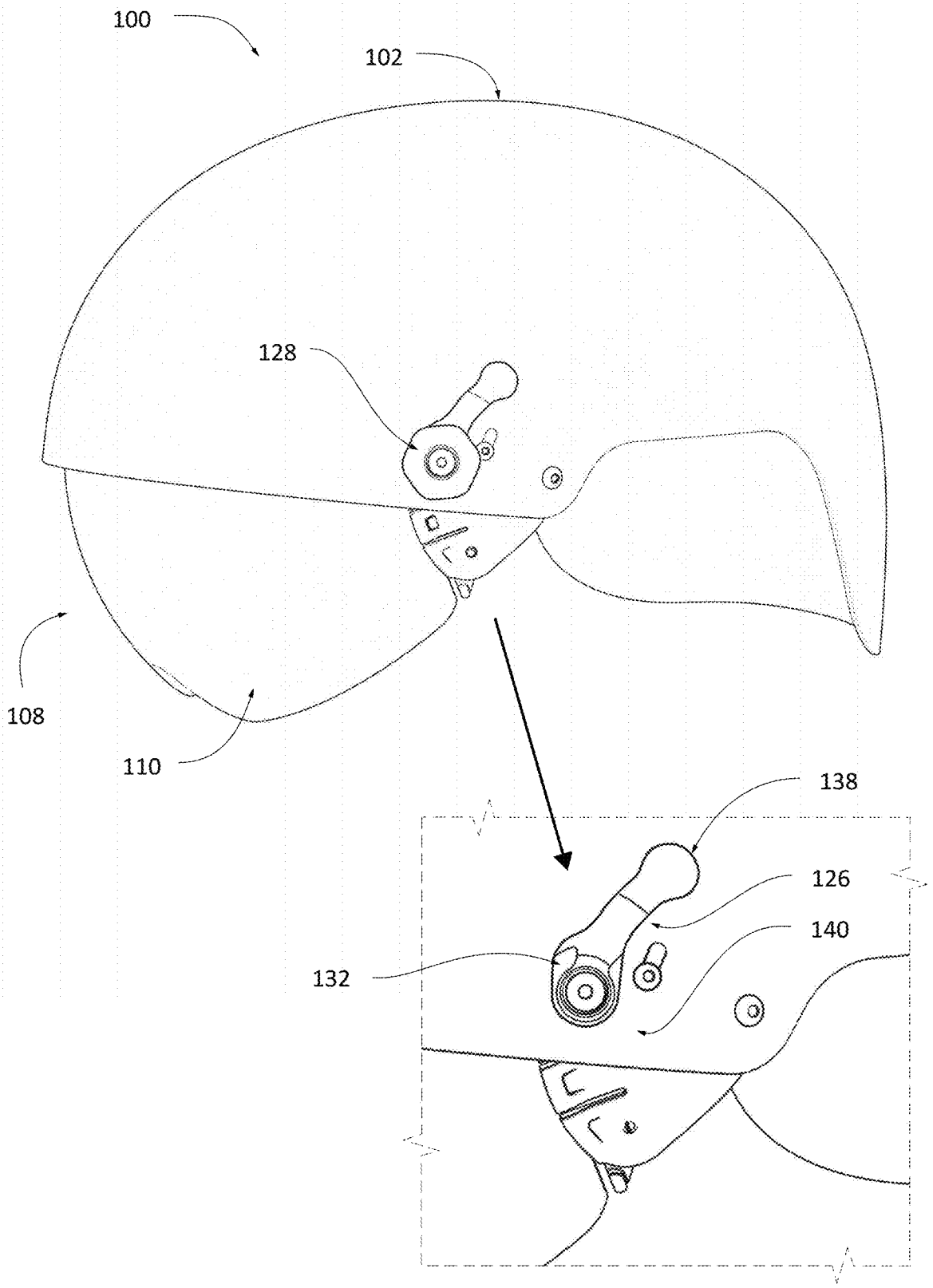
FIG. 5 is a perspective view an adjustable helmet visor system according to an embodiment of the present invention, showing an actuation knob engaging a positioning hook while the visor is in the deployed position.
Figure 6:
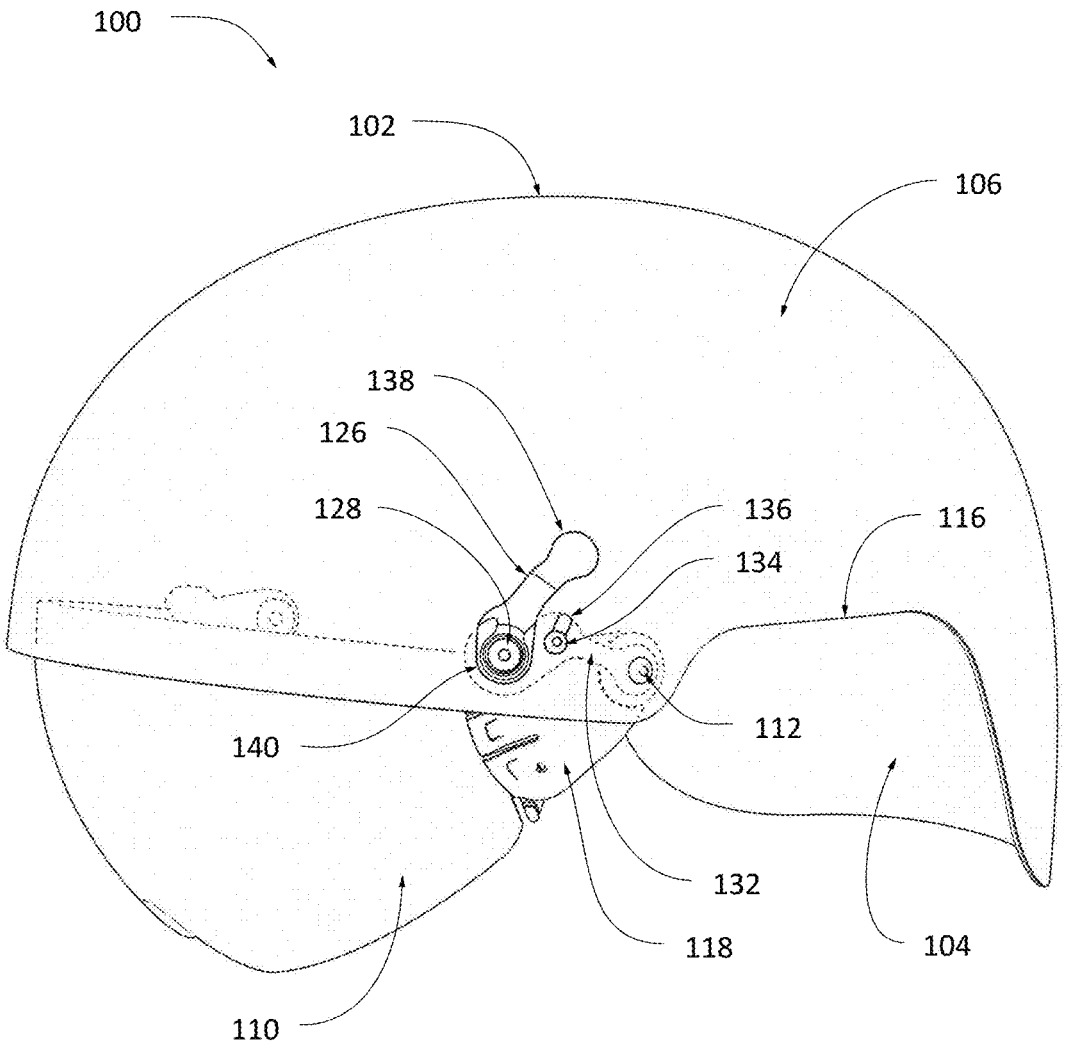
FIG. 6 is a perspective view of the system illustrated in FIG. 5, with occluded portions of components illustrated with broken lines.
Figure 7:
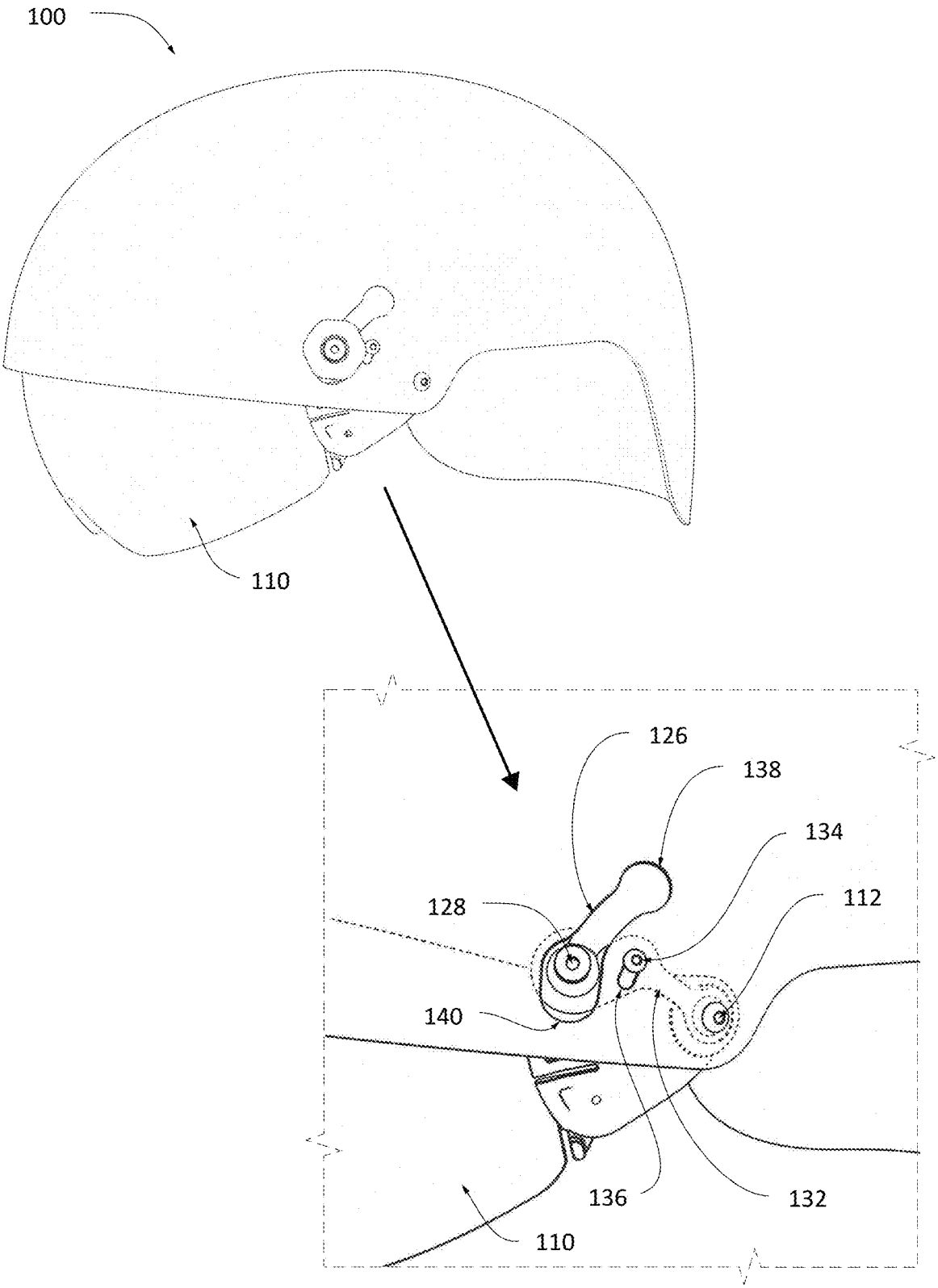
FIG. 7 is a perspective view of the system illustrated in FIG. 6, showing the actuation knob engaging the positioning hook while the visor is in the deployed position.
Figure 8:
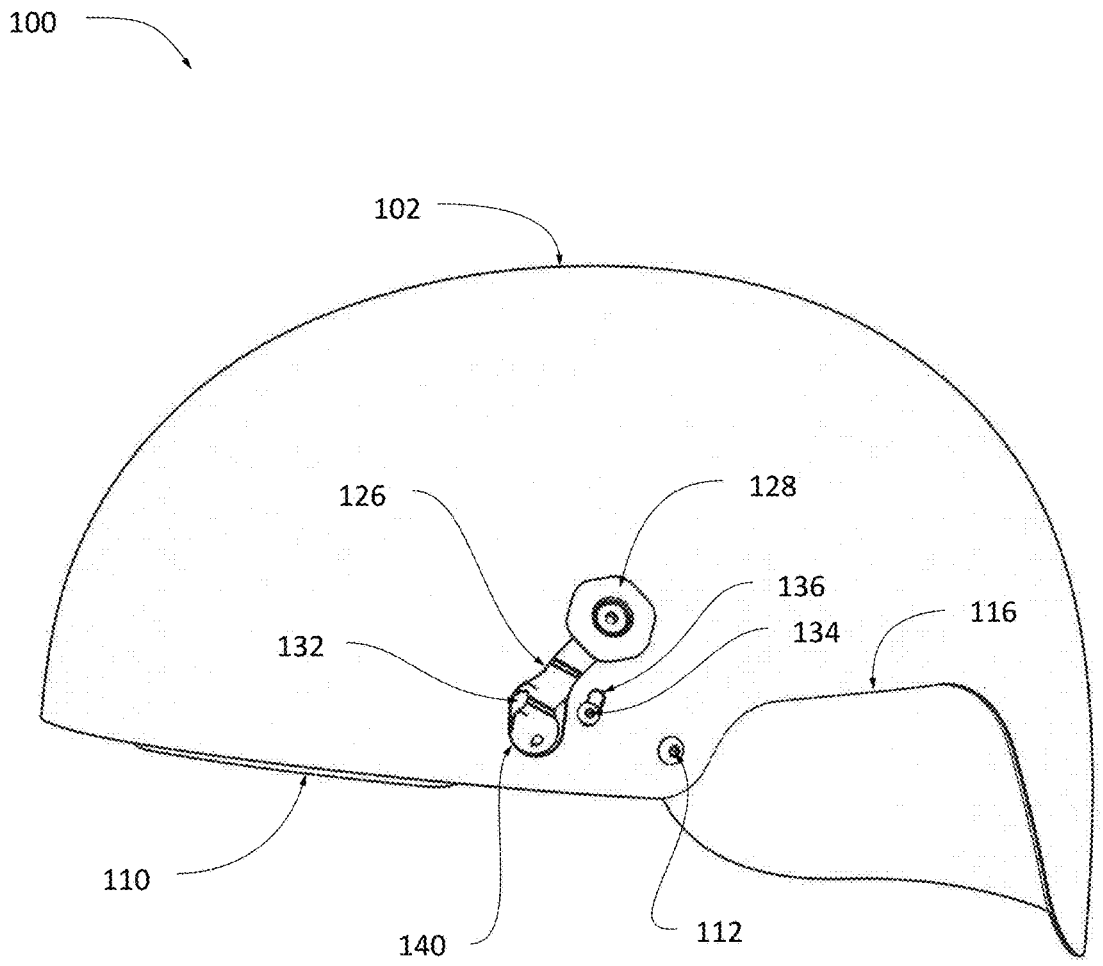
FIG. 8 is another perspective view of the system illustrated in FIG. 6, with the visor shown in a stored position and the actuation knob engaging an upper position of a visor actuator slot.
Figure 9:
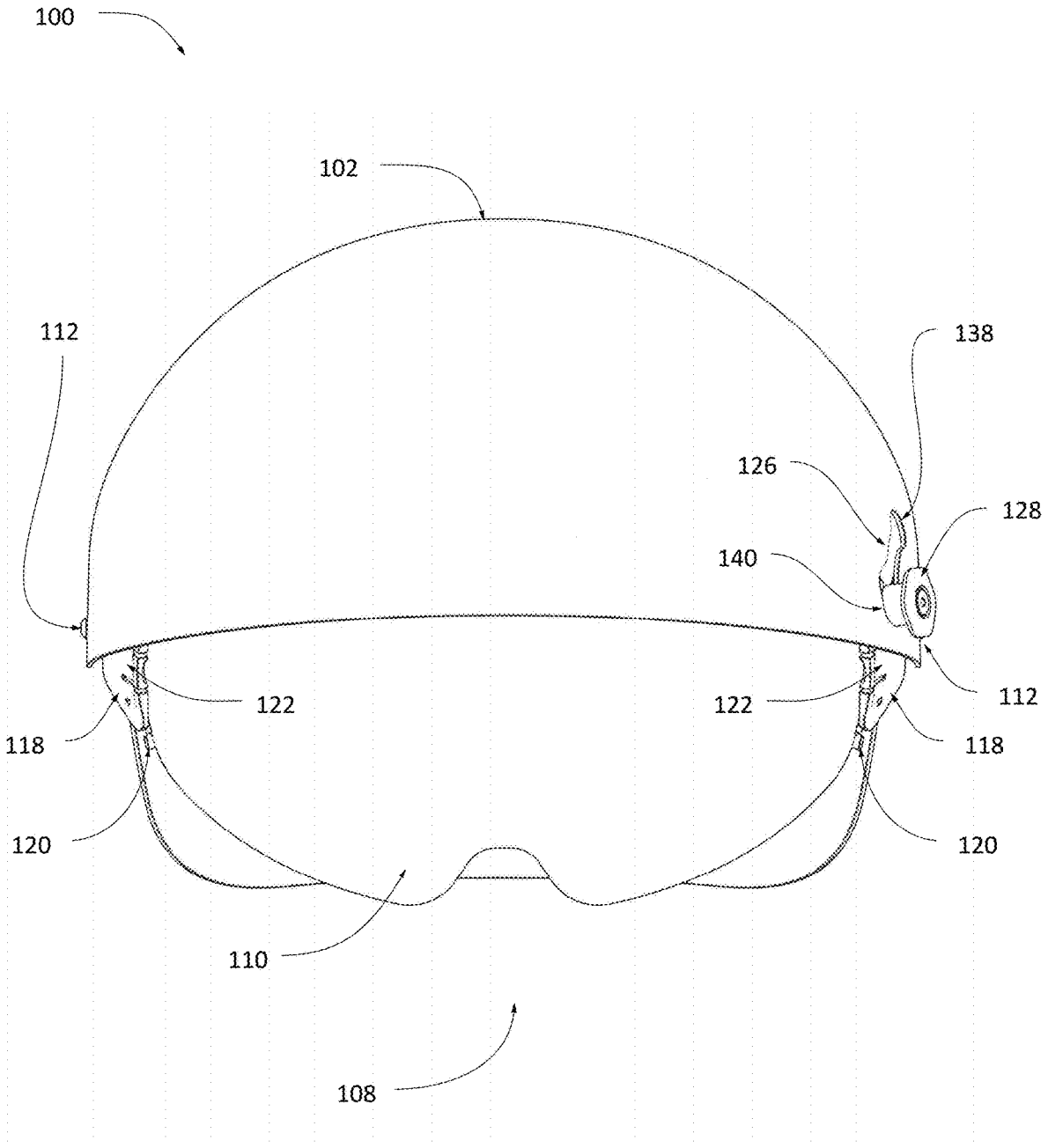
FIG. 9 is a frontal perspective view of the system illustrated in FIG. 8, with the visor shown in the deployed position.
Figure 10:
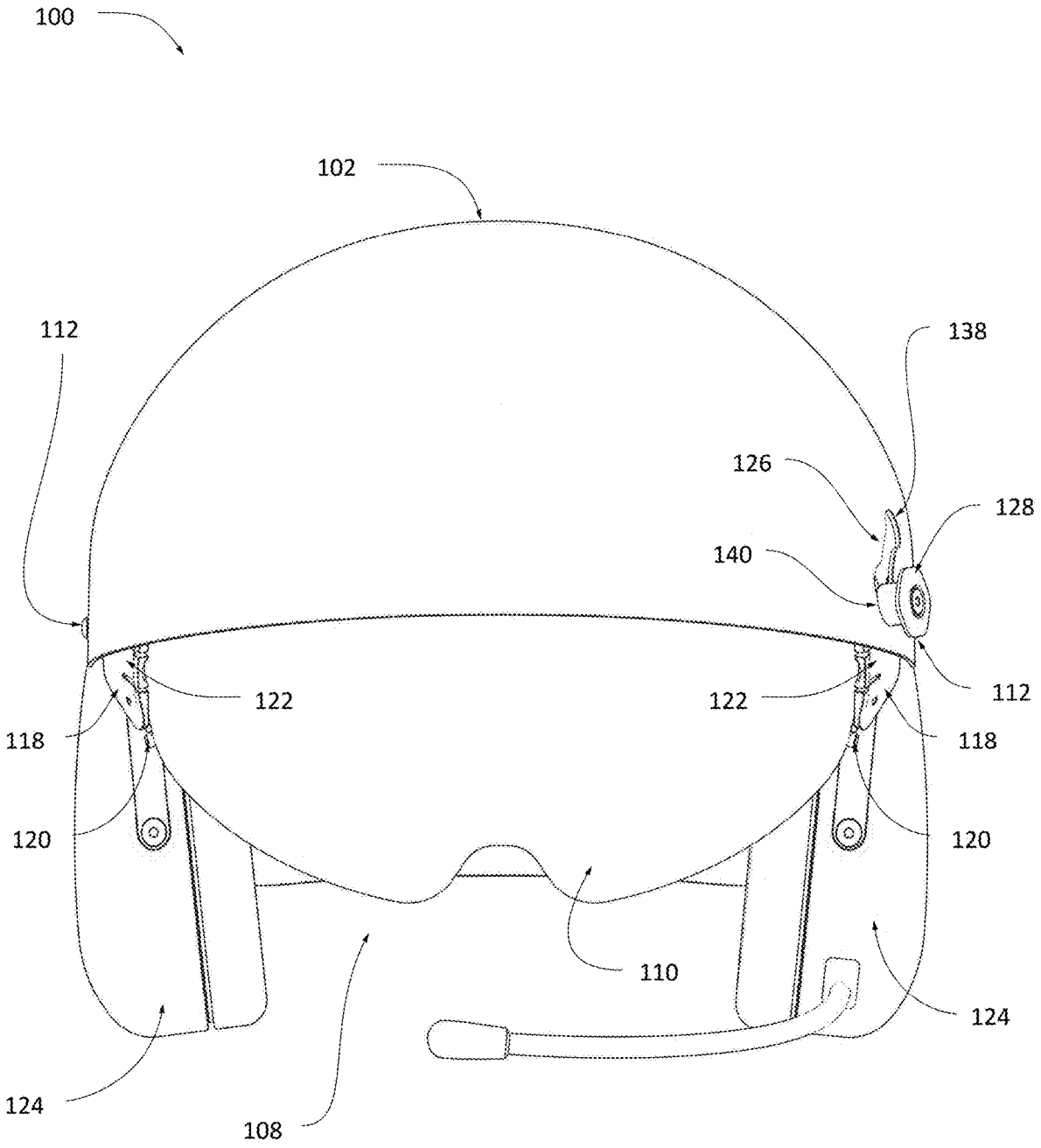
FIG. 10 is another front perspective view of the system illustrated in FIG. 9, showing a headset engaged with the helmet.
Figure 11:
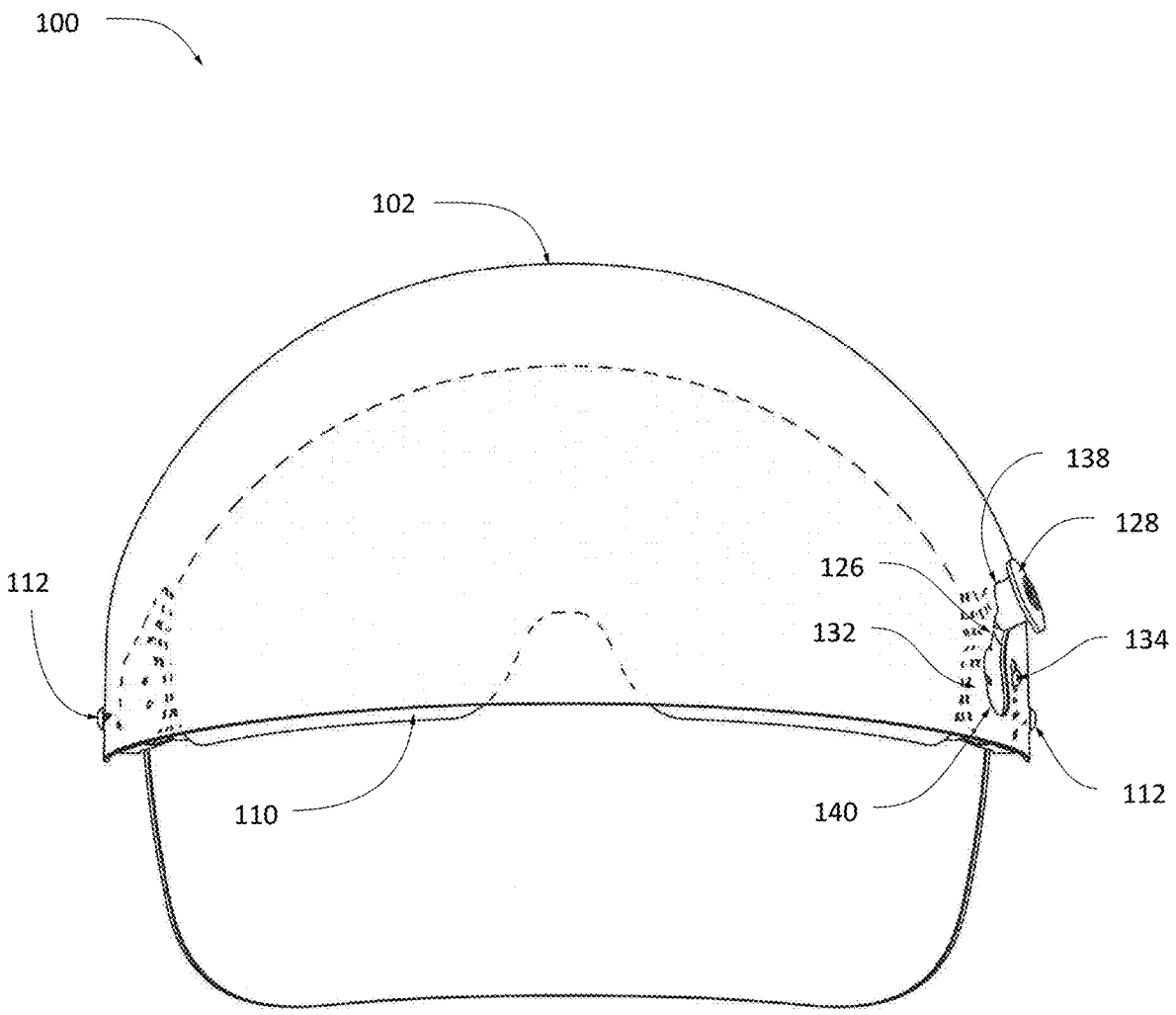
FIG. 11 is a front perspective view of an adjustable helmet visor system according to an embodiment of the present invention, showing the visor illustratively visible through the helmet in the stored position.
Figure 12:
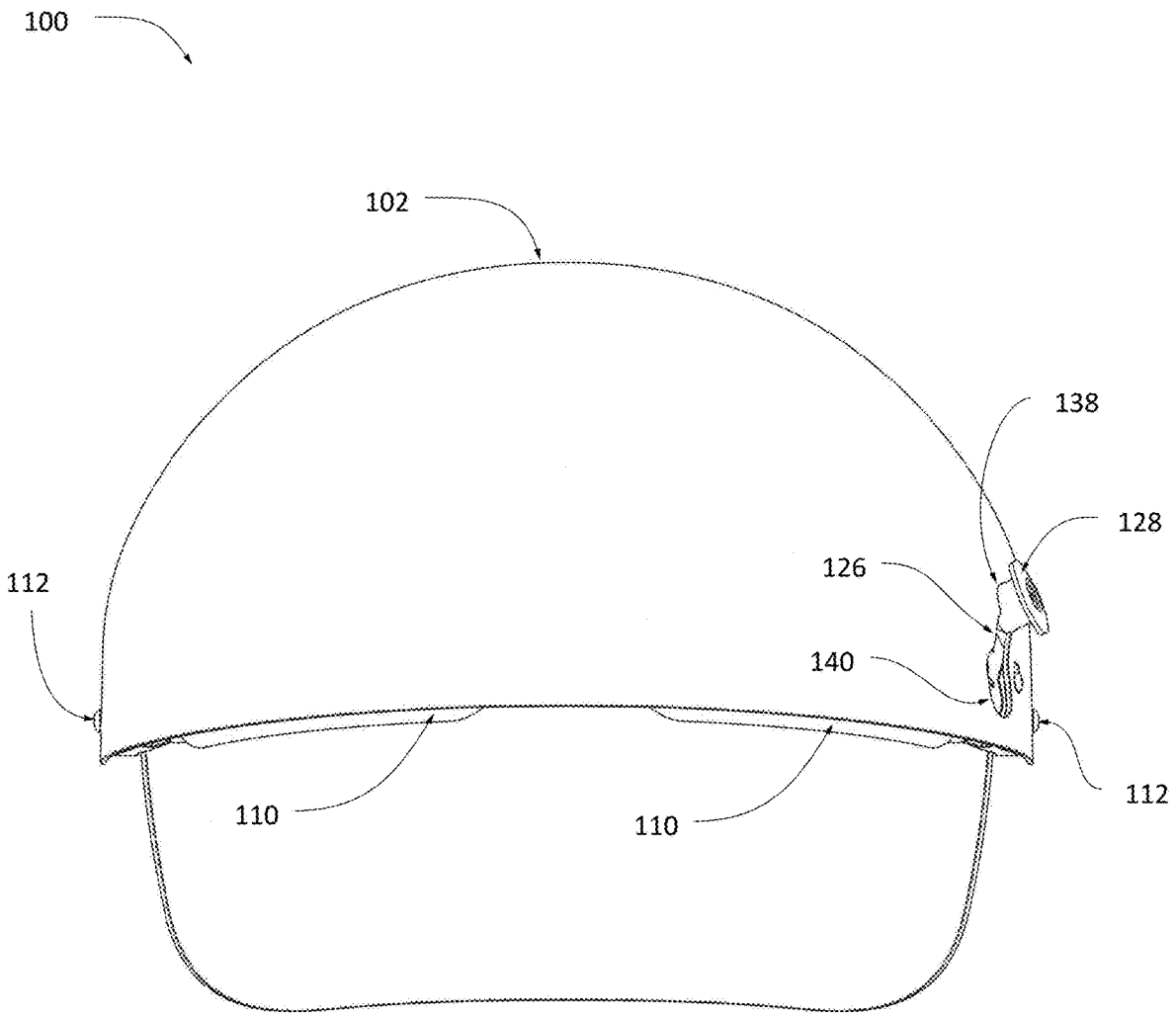
FIG. 12 is another front perspective view of the system illustrated in FIG. 11, without the visor not being illustratively visible through the helmet in the stored position.
Figure 13:
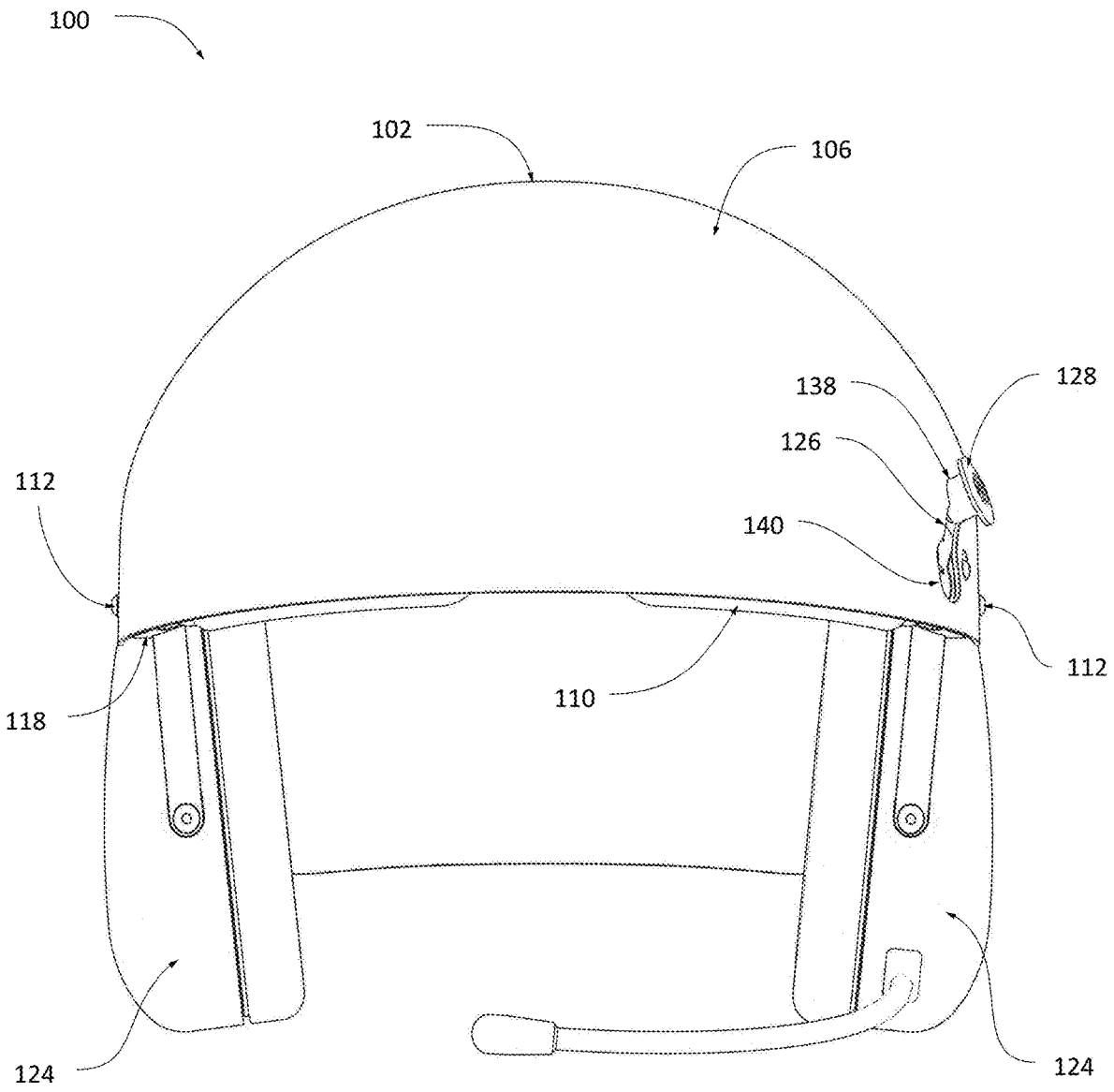
FIG. 13 is a front perspective view of the system illustrated in FIG. 12, showing the visor in a stored position and showing a headset connected to the helmet.
Figure 14:
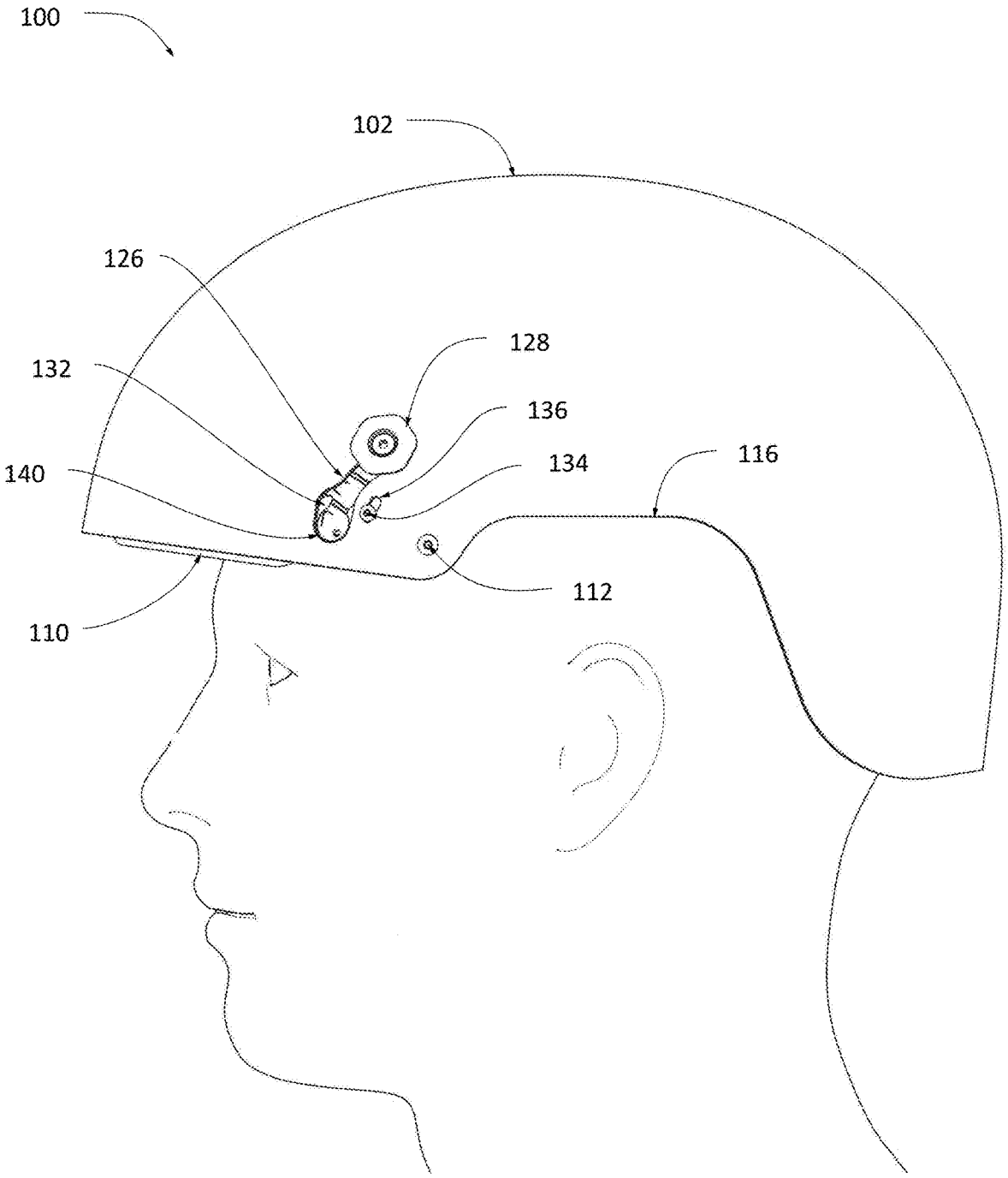
FIG. 14 is a side view of an adjustable helmet visor system according to an embodiment of the present invention, showing the visor in the stored position when in use and worn by a user.
Figure 15:
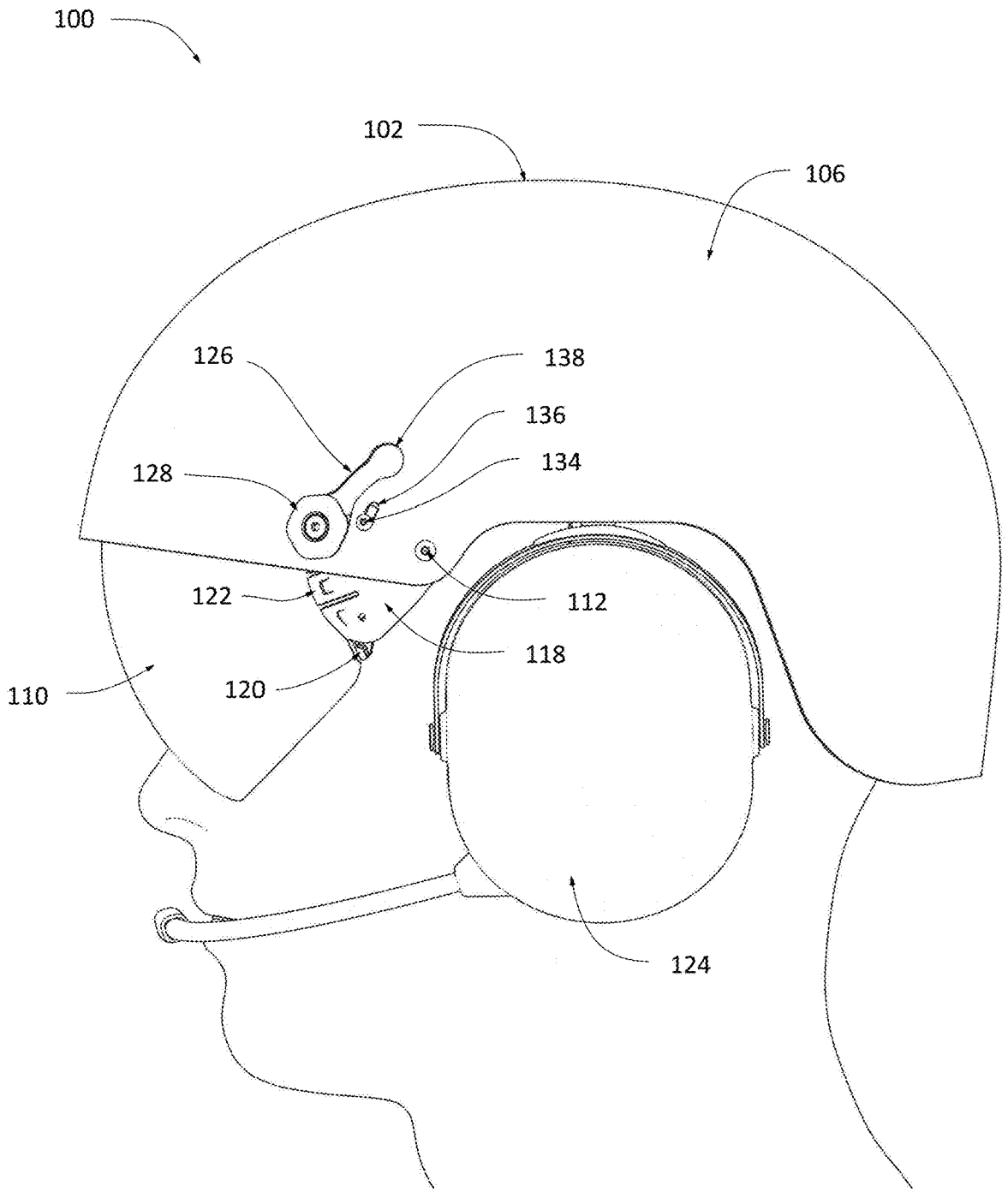
FIG. 15 is a perspective side view of the system illustrated in FIG. 14, showing the visor in the deployed position and the headset connected to the helmet and showing that the visor is moveable between the deployed position and the stored position without any interference with the headset when connected to the helmet.
Figure 16:
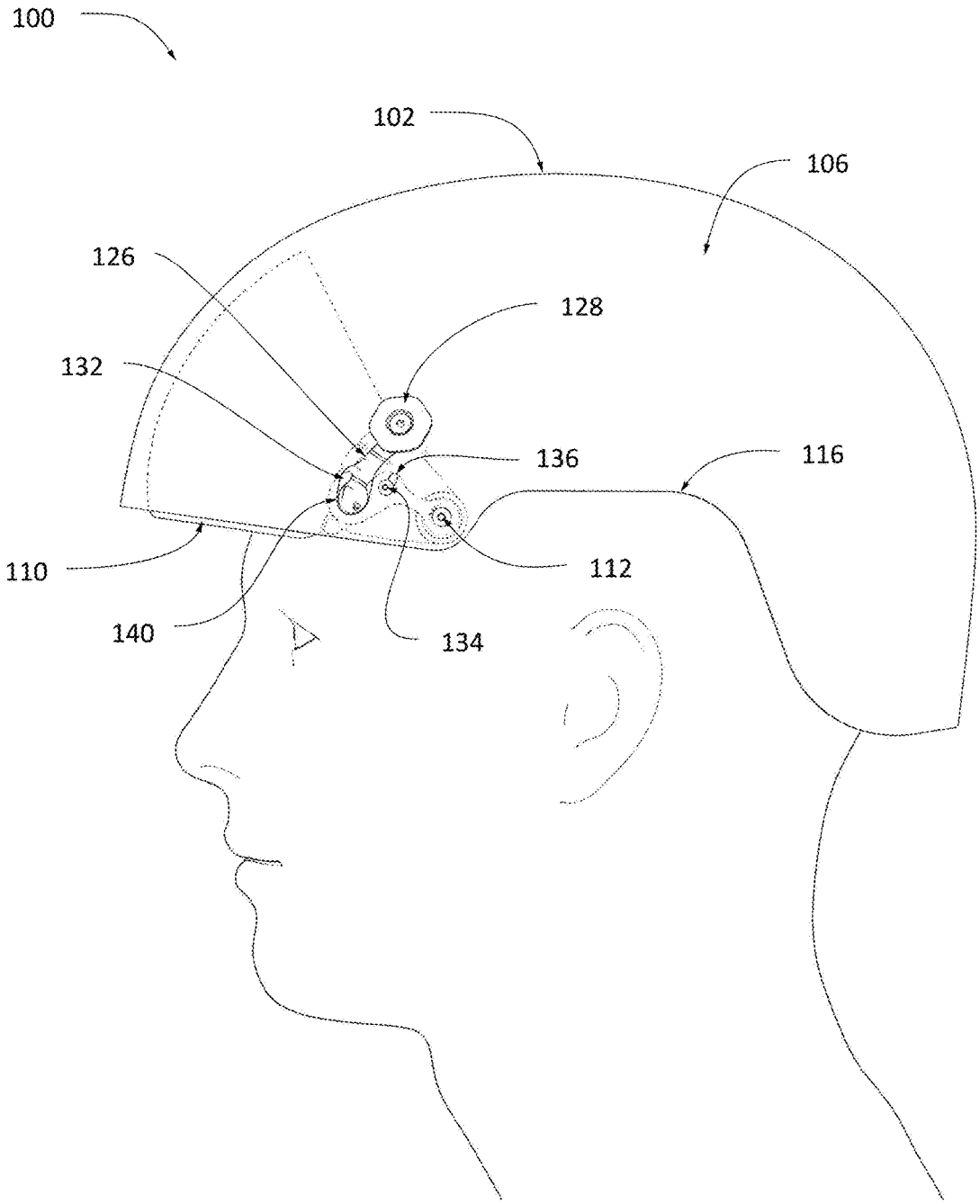
FIG. 16 is another perspective side view of the system illustrated in FIG. 14, showing the visor in the stored position and having portions of the helmet drawn to be semi-transparent to show the positioning of the visor when it is in the stored position within the helmet.
Figure 17:
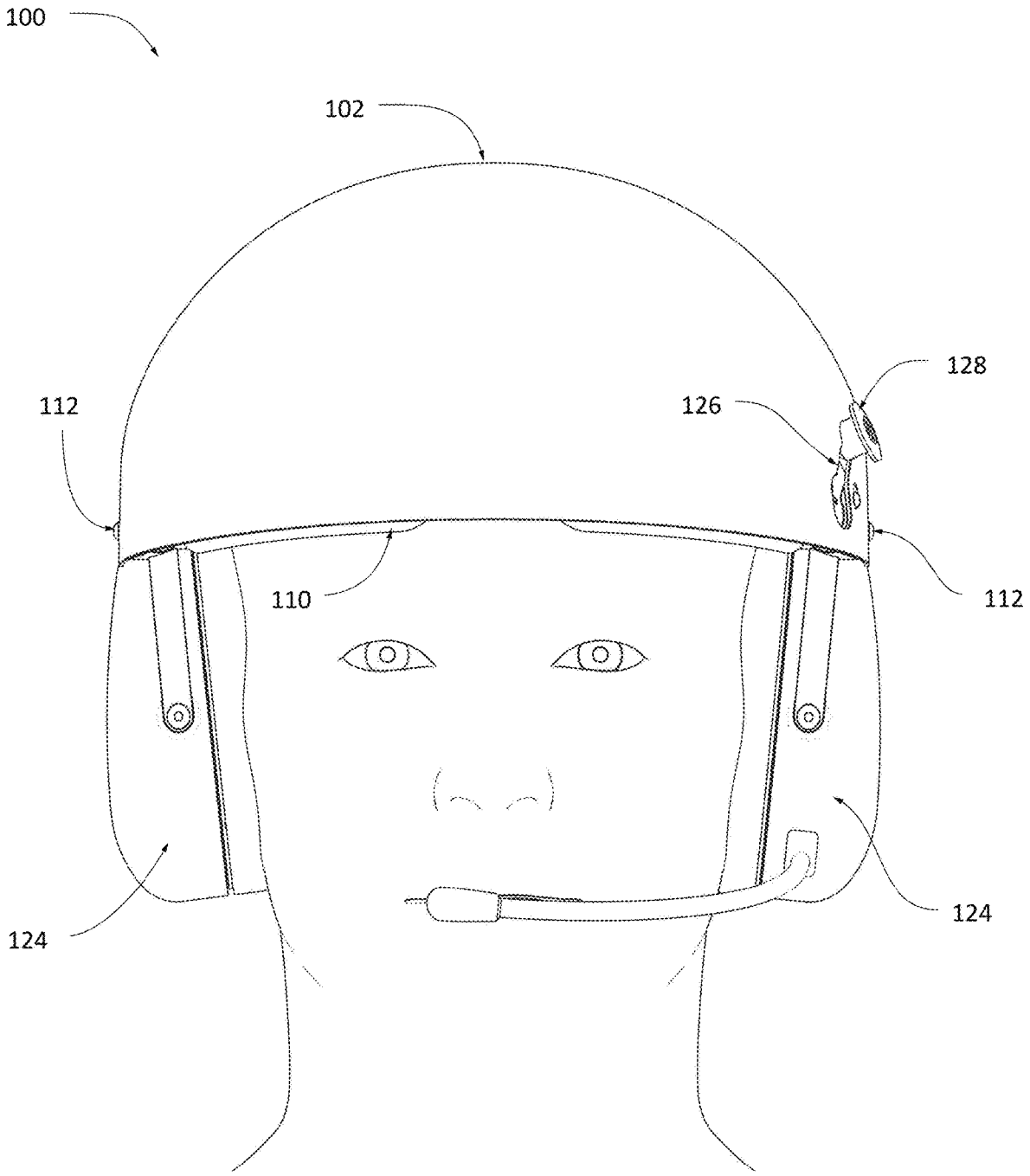
FIG. 17 is a front perspective view of an adjustable helmet visor system according to an embodiment of the present invention, showing the helmet and a headset being worn by a user with the visor in a deployed position and showing the geometry of the user's face with respect to the positioning of the visor when in the stored position.
Figure 18:
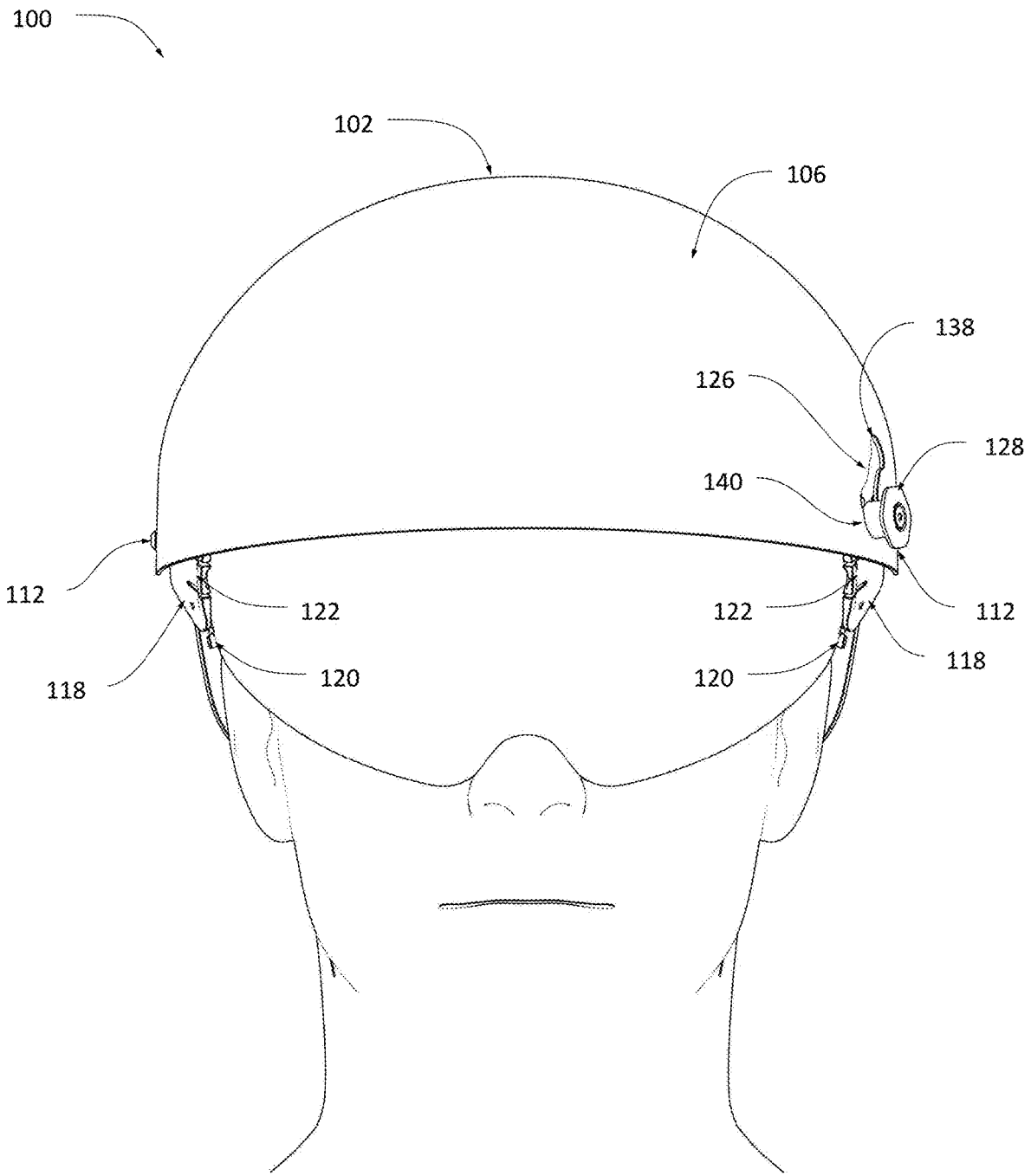
FIG. 18 is a front perspective view of the system illustrated in FIG. 17, showing the helmet being worn by a user with the visor in a deployed position, but without the headset.
Figure 19:
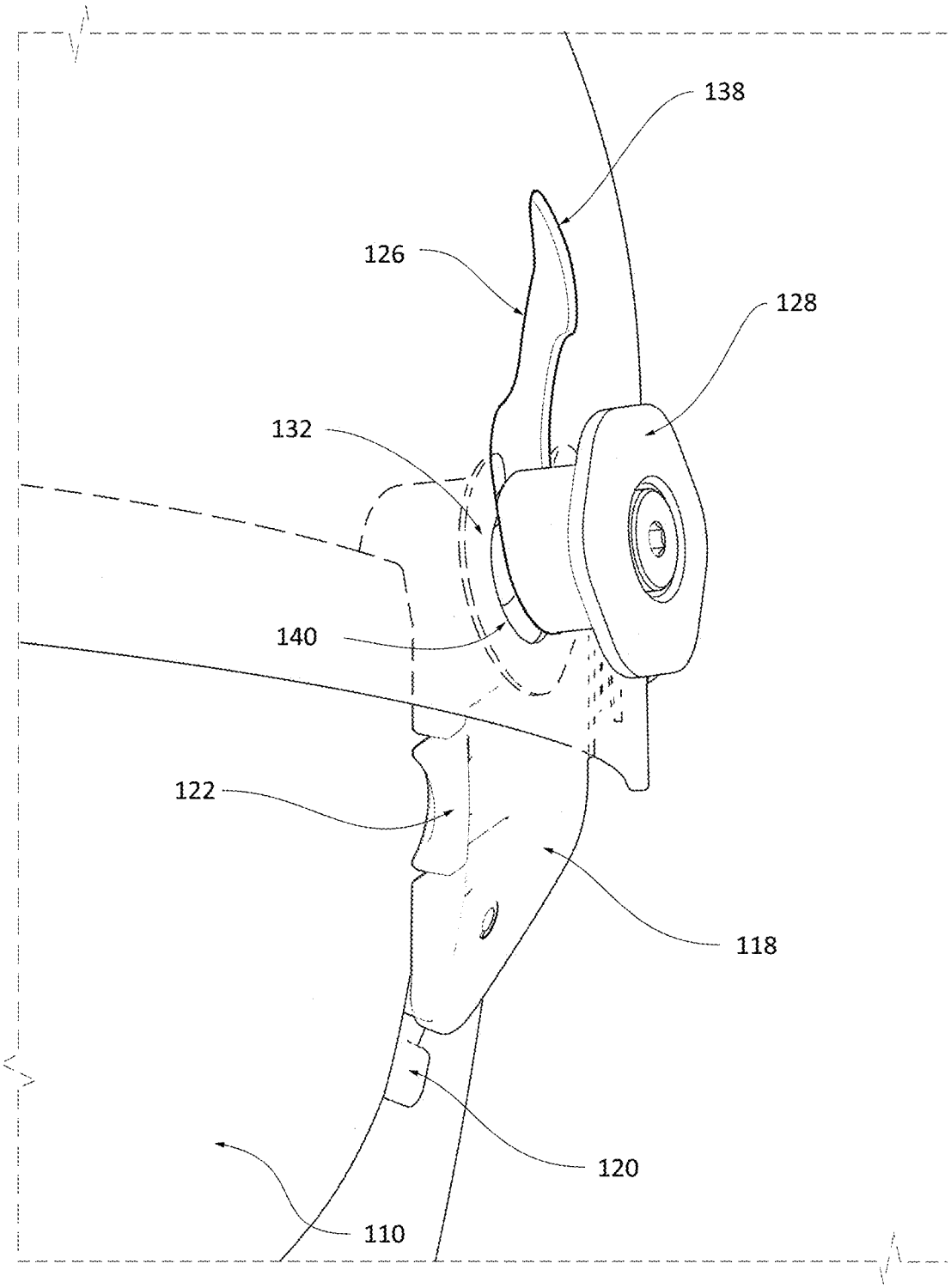
FIG. 19 is a partial perspective view of the system illustrated in FIG. 18, showing the actuation knob engaging a lower portion of the visor actuator slot and a positioning hook with the visor in the deployed position.
Figure 20:
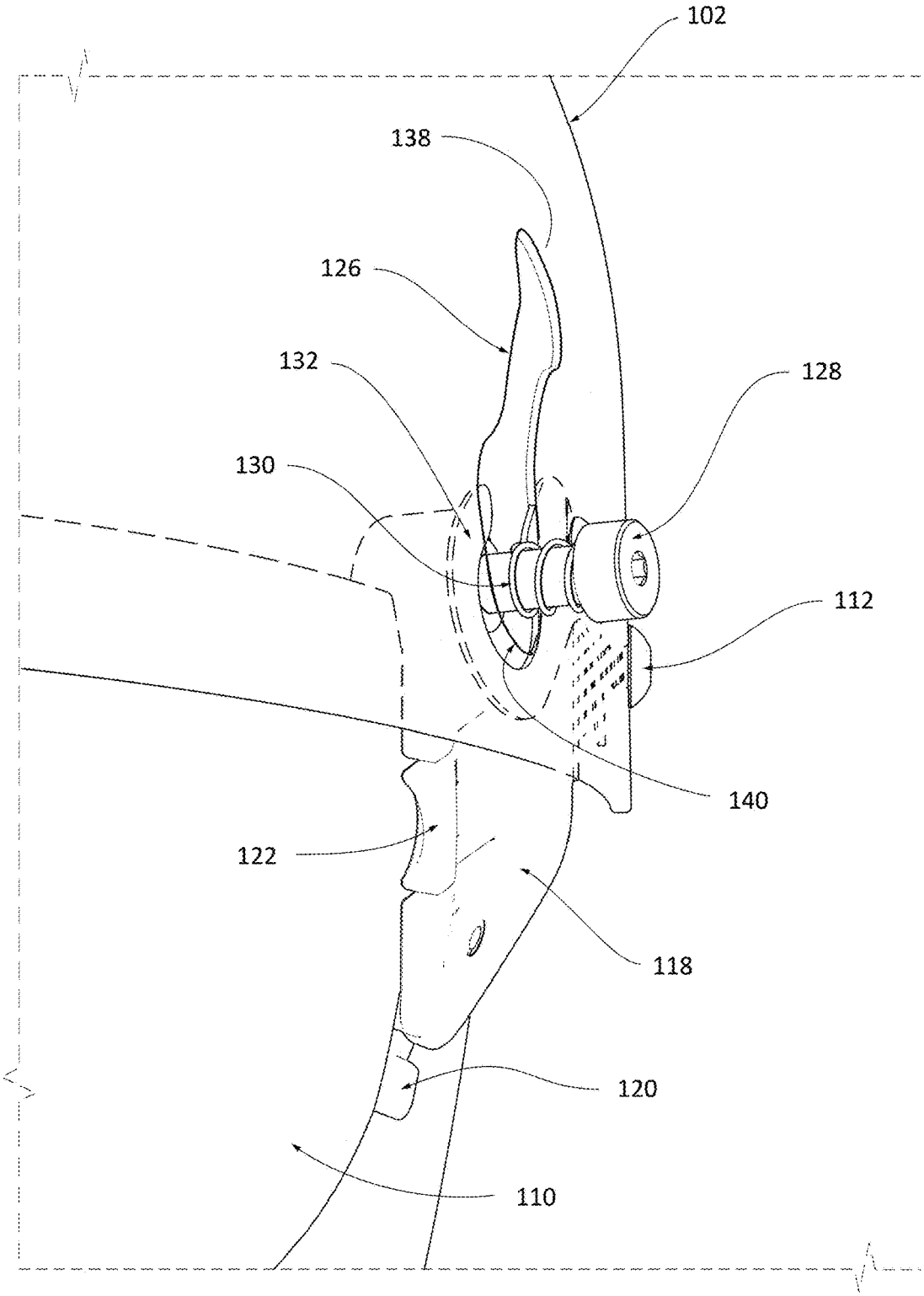
FIG. 20 is another partial perspective view of the system illustrated in FIG. 18, showing a knob lock spring being carried by the actuation knob to hold the actuation knob engaged with the positioning hook while the visor is in the deployed position.
Figure 21:
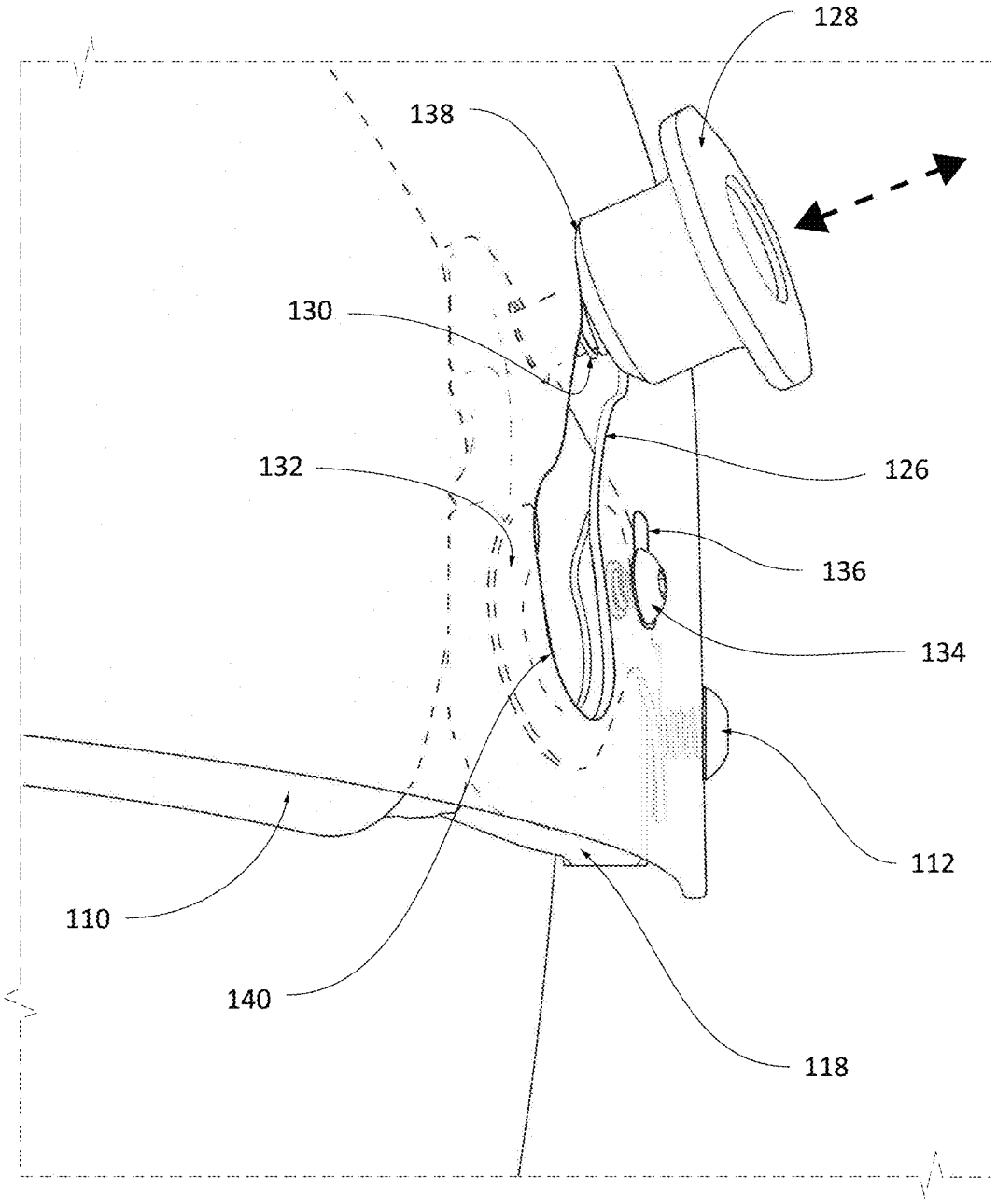
FIG. 21 is another partial perspective view of the system illustrated in FIG. 18, showing the visor in the stored position with the knob lock spring holding the actuation knob engaged with an upper portion of the visor actuator slot while the visor is in the stored position.
Figure 22:
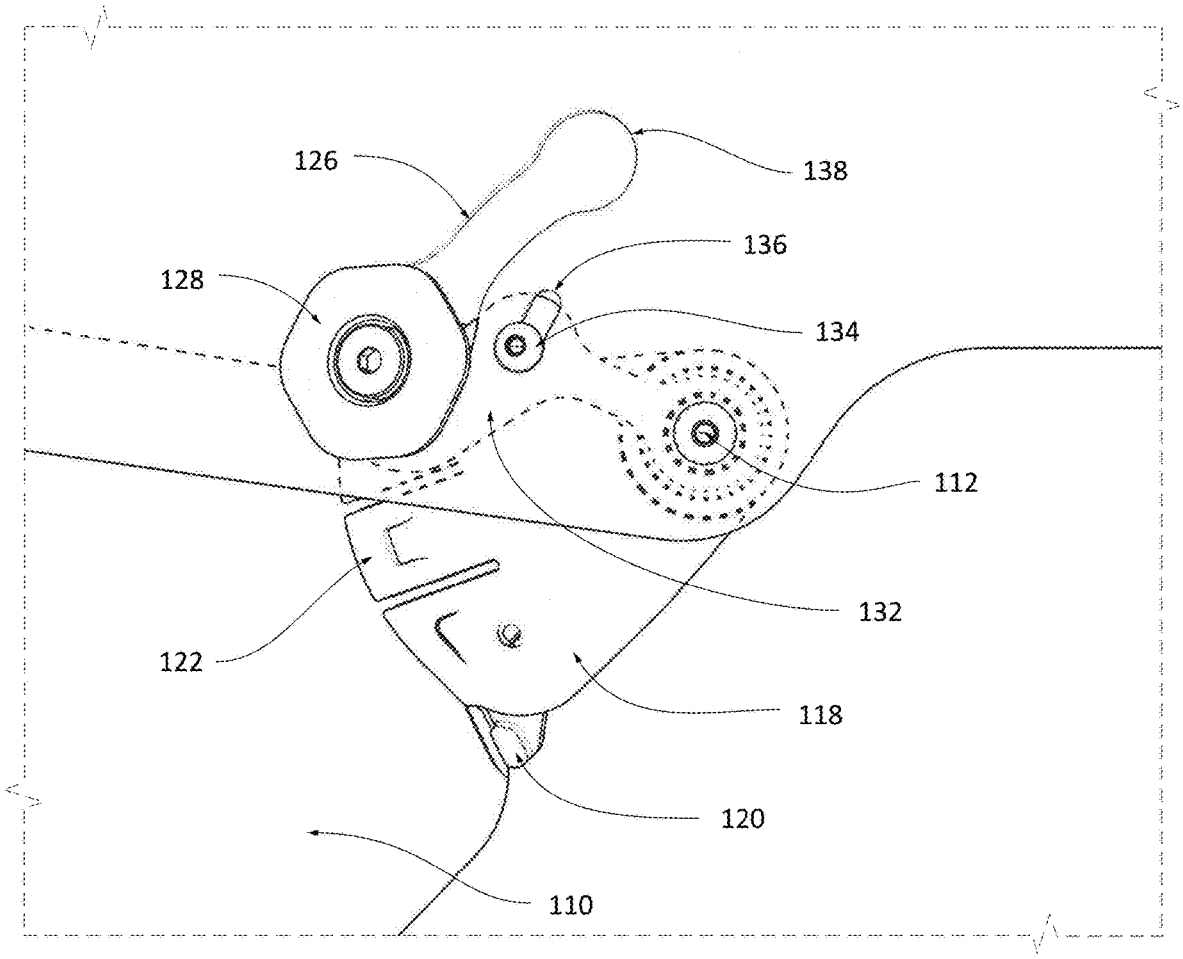
FIG. 22 is a side perspective view of the partial perspective view of the system illustrated in FIG. 21, showing the visor in the deployed position with a positioning lock screw at a lower portion of a lock screw slot to have the deployed position of the visor extend further from the helmet.
Figure 23:
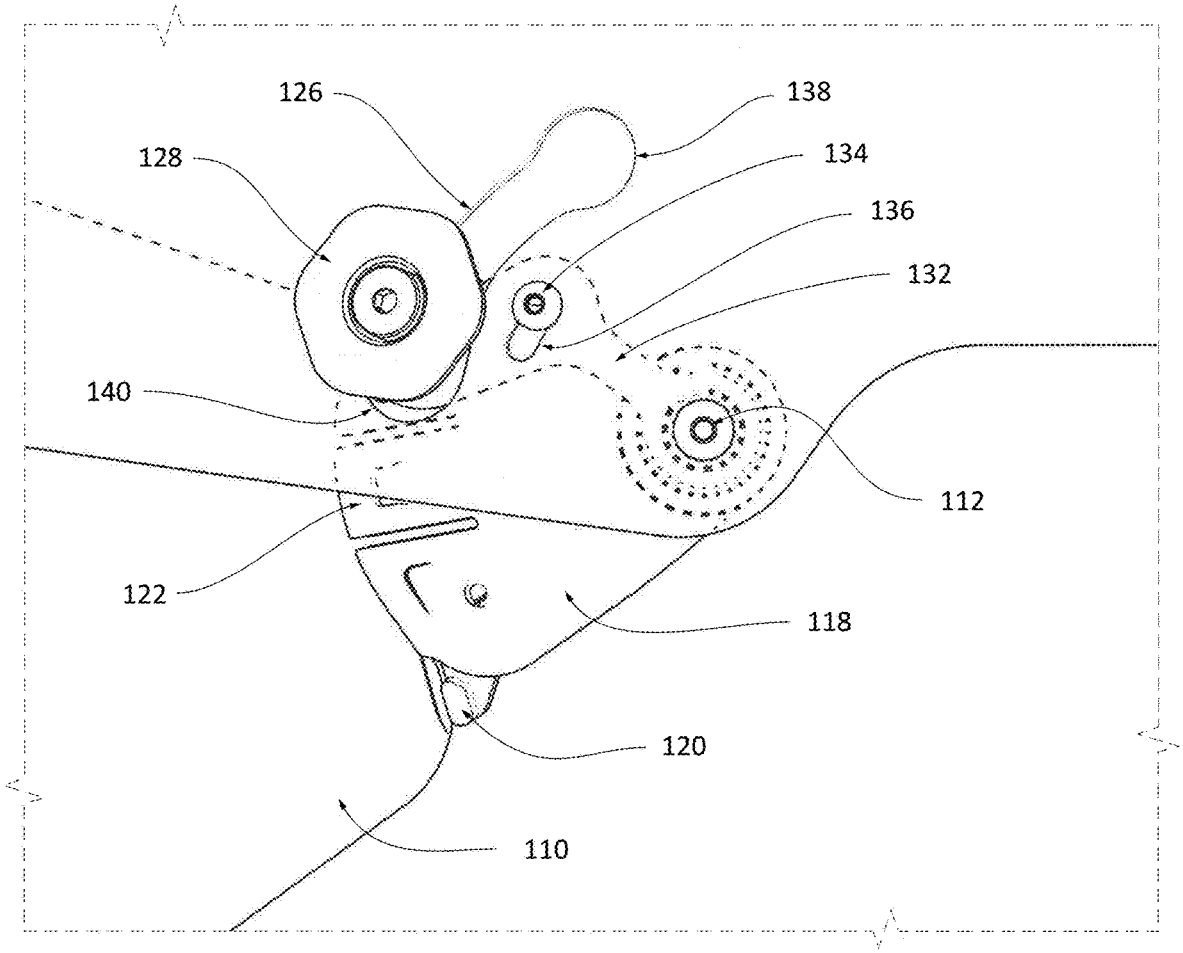
FIG. 23 is another side perspective view of the partial perspective view of the system illustrated in FIG. 21, showing the positioning lock screw at a higher portion of the lock screw slot to have the deployed position of the visor extend closer to the helmet.
Figure 24:
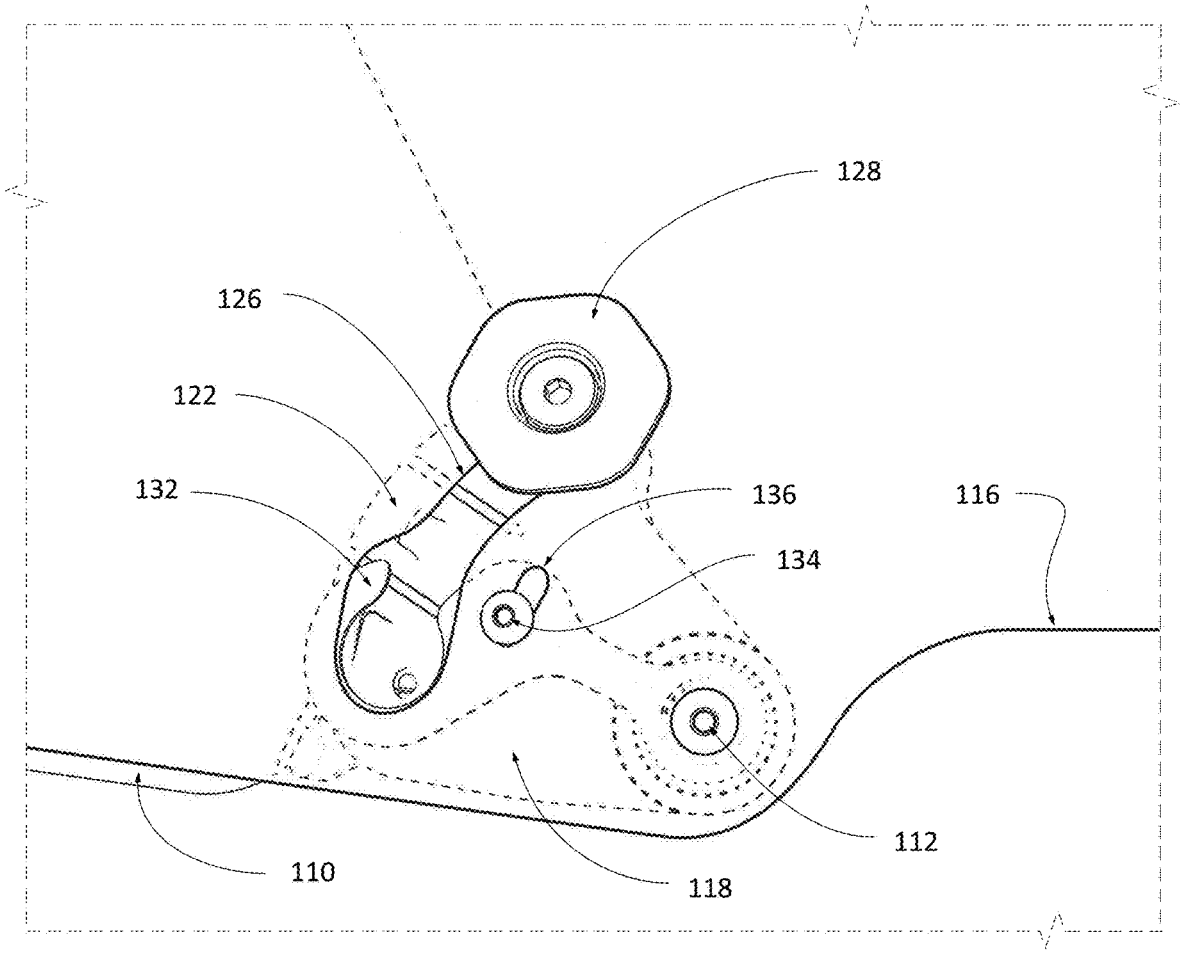
FIG. 24 is a partial perspective view of an adjustable helmet visor system according to an embodiment of the present invention, showing the visor in a stored position and the actuation knob engaging an upper portion of the visor actuator slot and the positioning lock screw fixed at a lower portion of the lock screw slot.
Figure 25:
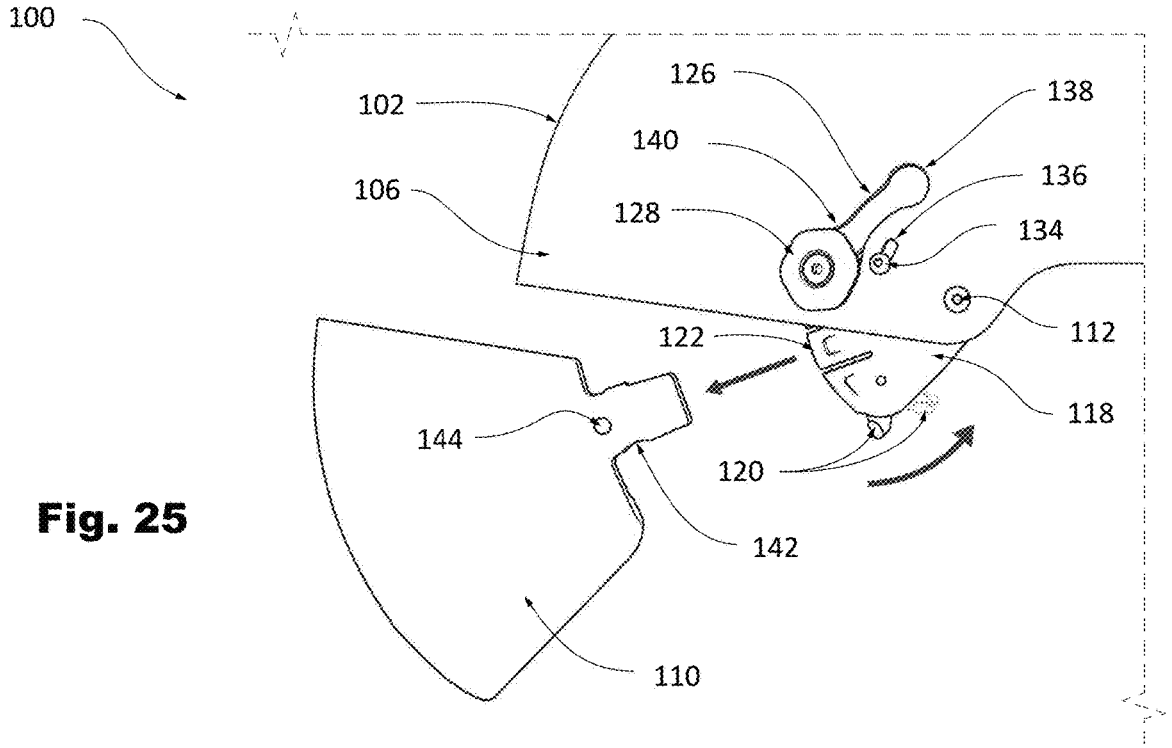
FIG. 25 is a partial perspective side view of an adjustable helmet visor system according to an embodiment of the present invention, showing the visor lens being removable from the lens carriers.
Figure 26:
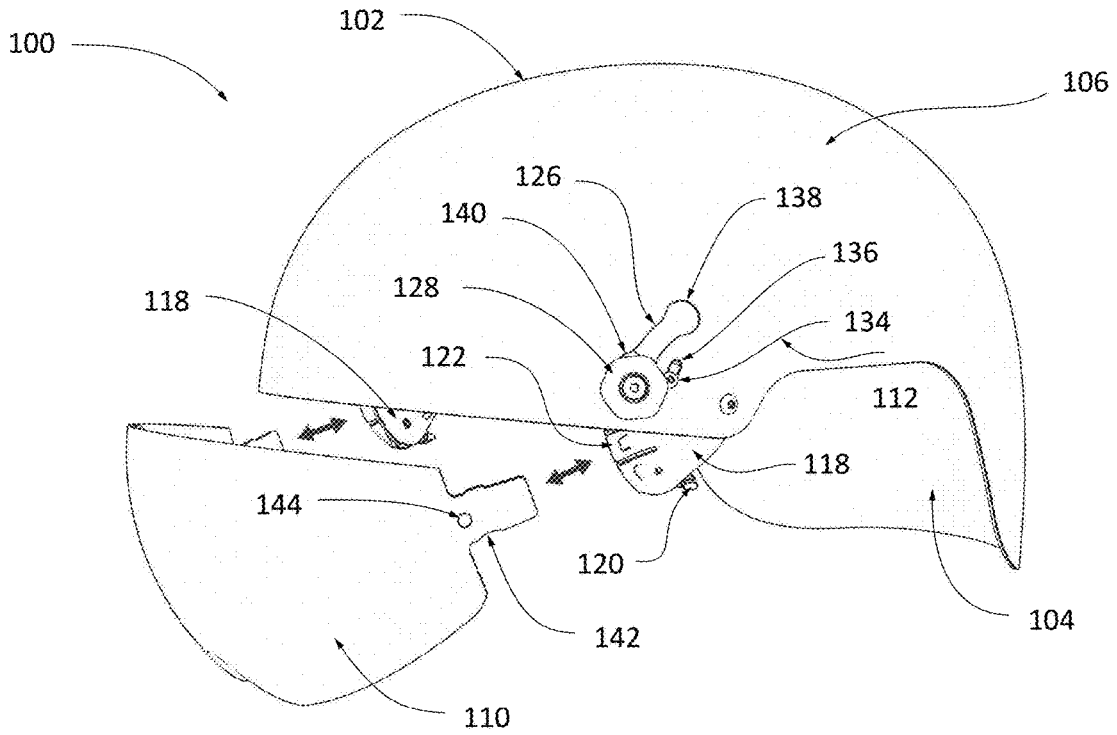
FIG. 26 is a perspective view of the system illustrated in FIG. 25.
Figure 27:
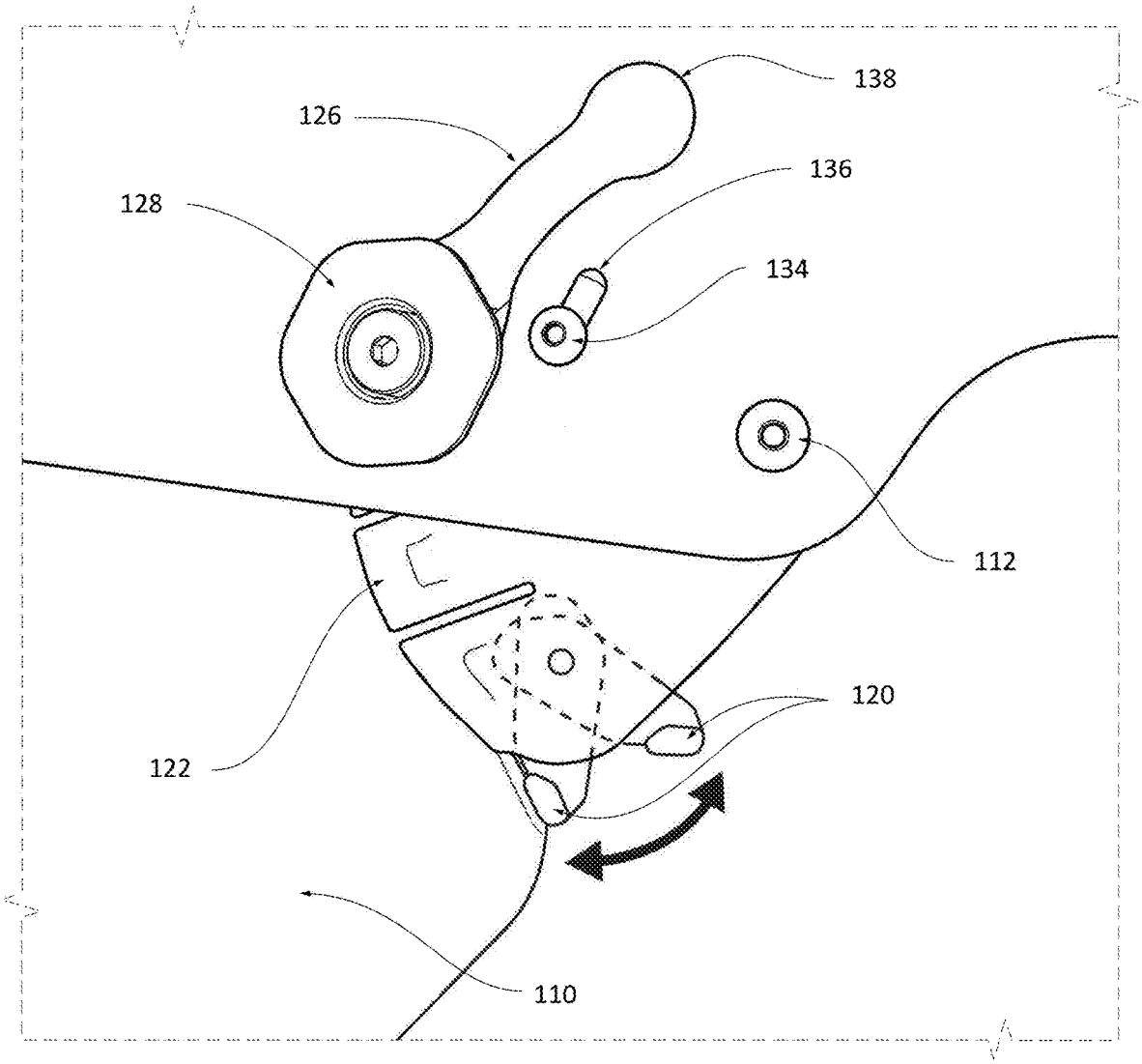
FIG. 27 is a partial perspective view of the system illustrated in FIG. 26, showing the first lever being moved to a locked state from an unlocked state.
Figure 28:
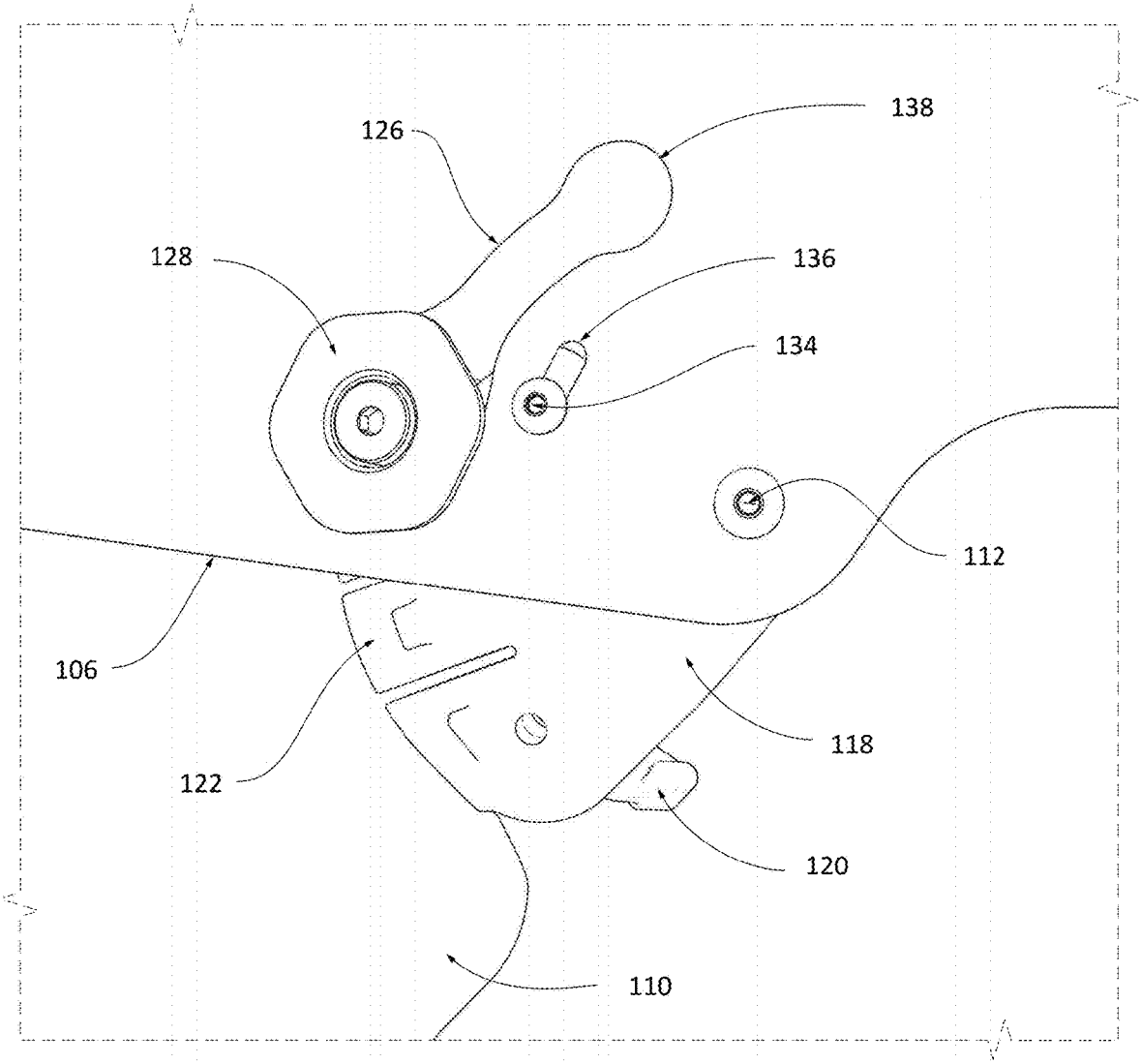
FIG. 28 is another partial perspective view of the system illustrated in FIG. 26.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the invention.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Furthermore, in this detailed description, a person skilled in the art should note that quantitative qualifying terms such as "generally," "substantially," "mostly," and other terms are used, in general, to mean that the referred to object, characteristic, or quality constitutes a majority of the subject of the reference. The meaning of any of these terms is dependent upon the context within which it is used, and the meaning may be expressly modified.

An embodiment of the invention, as shown and described by the various figures and accompanying text, provides an adjustable helmet visor system 100 for use in helmets 102 to provide for an adjustable visor apparatus 108 having a retractable visor 110 contained within a helmet 102, configured in such a way to allow the helmet 102 to be shaped in order to allow for a user wearing the helmet 102 to also wear a headset 124 that is nonconflicting with the visor apparatus 108 within the helmet 102. Those skilled in the art will appreciate that the helmet 102 referred to in this disclosure is one that can be used for any purpose. This is meant to include, but not be limited to, applications in aviation, military, sports, motorsports, water sports, or any other conceivable scenario in which a user may wear a helmet. Further, the helmet is not to be limited to use by adults. It is contemplated by the present invention that the helmet 102 according to aspects of the present invention can also be used by children as well. Further, the helmet 102 according to embodiments of the present invention may also have applications in the medical field and/or patient treatment fields.

Initially referring to FIG. 1 an adjustable helmet visor system 100 according to an embodiment of the present invention is presented. The system 100 may be installed into or carried by a helmet 102. The helmet 102 may include a helmet interior 104 and a helmet exterior 106. The system 100 may include a visor apparatus 108 having a visor lens 110 and one or more lens carriers 118. The lens carriers 118 may be removeable connectable to the visor lens 110 by a first lever 120 and a second lever 122 on each lens carrier 118. The first lever 120 and second lever 122 may be removably engaged with a side portion of the visor lens 110.

Now referring to FIGS. 25-28, the side portion of the visor lens 110 may include an engagement point 144 and a lens locking tab 142. The first lever 120 may be rotatably moveable between a locked and unlocked state. The locked state of the first lever 120 may be defined as when the first lever 120 is rotated to have a portion thereof in contact with and engaged with the lens locking tab 142 on the visor lens 110. The unlocked state of the first lever 120 may be defined as when the first lever 120 is rotatably moved so that the first lever 120 is not in contact with the lens locking tab 142 of the visor lens 110.

The second lever 122 may be configured to engage with the engagement point 144 on the visor lens 110. The second lever 122 may be readily movable from a locked state to a released state. The locked state of the second lever 122 may be defined as when the second lever 122 is in contact with and engaging an engagement point 144 on the visor lens 110. The unlocked state of the second lever 122 may be defined as when a force is applied to the second lever 122 so that the second lever 122 is not engaged with an engagement point 142 on the visor lens 110.

Now referring to FIGS. 1-24, the helmet 102 of the system 100 may include a pivot through hole 114 positioned on one or more sides of the helmet 102. The pivot through holes 114 may extend through the helmet exterior 104 and may extend through the helmet interior 106. The pivot through holes 114 may be configured to be matingly engaged with a respective pivot member 112. The pivot member 112 may be fixedly attached to one of the lens carriers 118. The visor lens 110 and the lens carriers 118 may be configured to rotatably move with respect to the helmet 102 and/or the pivot members 112.

Some embodiments of the present invention may include a visor actuator slot 126, an actuation knob 128, a positioning hook 132, a positioning lock screw 134, and a lock screw slot 136. The visor actuator slot 126 may be located on and extending through a portion of the helmet 102. The actuation knob 128 may be attached to extending from one of the lens carriers 118 and the actuation knob 128 may be positioned extending through the visor actuator slot 126. The actuation knob 128 may actuate relative to the respective lens carrier 118 that the actuation knob 128 is attached to, and the actuation knob 128 may include a knob lock spring 130 attached to and extending between the actuation knob 128 and the lens carrier 118. The actuation knob 128 may have varying widths such that when the actuation knob 128 is pulled upon directed away from the lens carrier 118 that the actuation knob 128 is attached to, that the actuation knob 128 reveals a portion thereof that is smaller than the width of the visor actuator slot 126.

The knob lock spring 130 may be configured to apply a constant force on the actuation knob 128 towards the respective lens carrier 118. The visor actuator slot 126 may include an upper portion 138 (the upper position slot) and a lower portion 140 (the lower position slot). The upper position slot 138 of the visor actuator slot 126 may comprise of a width equal to or greater than a width of the actuation knob 128. The lower position slot 140 of the visor actuator slot 126 may have a width that is greater than the width of the actuation knob 128.

The positioning hook 132 may be rotatably connected to the pivot member 112, and the positioning hook 132 may extend adjacent to the lower position slot 140 of the visor actuator slot 126. The positioning hook 132 may have its adjacent position relative to the lower portion of the lower position slot 140 of the visor actuator slot 126 adjusted by the positioning lock screw 134. The positioning lock screw 134 may extend into a lock screw slot 136 that extends through at least one of the helmet exterior 106, the positioning hook 132, the helmet interior 104, and one of the lens carriers 118. The lock screw slot 136 may have a width that is equal to or greater than a portion of the positioning lock screw 134, and the lock screw slot 136 may have an elongated shape along the helmet 102, for example, and without limitation, a uniform elongated oval shape.

The positioning lock screw 134 may be readily fixed and unfixed to adjust the placement of the positioning hook 132 adjacent to the lower position slot 140 of the visor actuator slot 126. The position of the positioning hook 132 may limit an extent to which the visor lens 110 can move to a deployed position from a stored position. This is advantageous as the face configuration of users may differ and it may be necessary for users to require the visor to be deployed to different positions. Accordingly, the interaction of the positioning lock screw 134 and the positioning hook 132 may advantageously allow for customized deployment of the visor lens 110. The deployed position of the visor lens 110 may be defined as when a majority of the visor lens 110 is visible and extending from the helmet 102 when the visor lens 110 and the lens carrier 118 are rotatably moved relative to the helmet 102. The stored position of the visor lens 110 may be defined as when a majority of the visor lens 110 is not visible and occluded by the helmet.

Upon the visor lens 110 being moved to the deployed position, the positioning hook 132 may engage, catch, and/or abut the actuation knob 128 such that the visor lens 110 is prevented from further extending from the helmet 102. Upon the visor lens 110 being moved to the deployed position, the actuation knob 128 may be matingly engaged with the positioning hook 132 by being pulled towards the lens carrier 118 that the actuation knob 128 is attached to by the knob lock spring 130, which may be defined as when the actuation knob 128 is in a locked deployed position. The actuation knob 128 may be moveable to a stored locked position. The stored locked position may be defined as when the visor lens 110 is in the stored position and the upper position slot 138 of the visor actuator slot 126 is positioned between the actuation knob 128 and the lens carrier 118 that the actuation knob 128 is attach to, and the knob lock spring 130 forces the actuation knob 128 to engage with the upper position slot 138 of the visor actuator slot 126, preventing the visor lens 110 from rotatably moving relative to the helmet 102.

The visor lens 110 may be removeable from the lens carriers 118 that it is attached thereto. To remove the visor lens 110 the first levers 120 may first be moved to the unlocked state to disengage their respective engagement points 144 on the visor lens 110, as illustratively shown in FIGS. 26 and 27. The second levers 122 may then be moved to the unlocked state from the locked state by pulling the second levers 122 directed away from the lens carriers 118 such that the second levers 122 disengage their respective engagement points 144. Then the visor lens 110 may be removed from the lens carriers 118.

The helmet 102 may include two cutouts 116 to allow for a user of the helmet to wear a headset 124 simultaneously with the helmet 102, as illustratively shown throughout the figures. The cutouts 116 may be extending through and located adjacent to a lower side-central portion of the helmet 102, essentially where a user's ears are expected to be positioned when wearing the helmet 102. Due to the placement of the cutouts 116 to accommodate a headset 124 worn by a user, those skilled in the art will notice and appreciate that the pivot member 112 of the visor apparatus 108 is placed in a position on the helmet so that the configuration of the pivoting of the visor allows for the visor lens to be moved without any interference or without moving the visor into the area of the helmet that has cutouts for the ears. This advantageously allows for a headset to be worn by the user without any interference from the visor lens being moved between the deployed position and the retracted or stored position.

Some of the illustrative aspects of the present invention may be advantageous in solving the problems herein described and other problems not discussed which are discoverable by a skilled artisan.

While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made, and equivalents may be substituted for elements thereof without departing from the scope of the invention. In addition, many modifications may be made to adapt a particular situation or material to the teachings of the invention without departing from the essential scope thereof. Therefore, it is intended that the invention is not limited to the particular embodiment disclosed as the best or only mode contemplated for carrying out this invention, but that the invention will include all embodiments falling within the description of the invention. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

Thus the scope of the invention should be determined by the appended claims and their legal equivalents, and not by the examples given.

What is claimed is:

1. A helmet visor system comprising:

a helmet shaped and configured to cover an upper portion of a head and shaped to accommodate a headset, the helmet including a helmet interior and a helmet exterior;

a visor lens retractably carried by the helmet; and a visor apparatus carried by the helmet and connected to the visor lens to pivotally move the visor lens between a stored position and a deployed position;

wherein the deployed position of the visor lens is defined as a majority of the visor lens being extended from the helmet;

wherein the stored position of the visor lens is defined as the visor lens being positioned within the helmet interior and the majority of the visor lens being occluded by the helmet;

wherein the visor lens is pivotally moveable between the stored position and the deployed position so as not to interfere with the headset while the headset is used in conjunction with the helmet.

2. The system according to claim 1, further comprising a first visor carrier and a second visor carrier; wherein each of the first visor carrier and the second visor carrier have portions connected to the visor lens and portions pivotally connected to the helmet.

3. The system according to claim 2, further comprising an actuation knob extending through a visor actuator slot and attached to the first visor carrier; wherein the actuation knob is movable between an upper portion of the visor actuator slot and a lower portion of the visor actuator slot.

4. The system according to claim 3, wherein the actuation knob is moveable between an engaged position and a disengaged position when positioned in at least one of the upper portion and the lower portion of visor actuator slot; wherein when in the disengaged position, the actuation knob is moveable between the upper portion and the lower portion of the visor actuator slot; and wherein when in the engaged position, the actuation knob is fixed from movement between the upper portion and the lower portion of the visor actuator slot.

5. The system according to claim 4, wherein the actuation knob is movable between a stored locked position and a deployed locked position; wherein the stored locked position is defined as when the actuation knob is moved to the upper portion of the visor actuator slot and in the engaged position; and wherein the deployed lock position is defined as when the actuation knob is moved to the lower position of the visor actuator slot and in the engaged position.

6. The system according to claim 5, further comprising a knob lock spring to cause the actuation knob to move from the disengaged position to the engaged position.

7. The system according to claim 4, further comprising a positioning hook rotatably attached to the helmet and moveable within the visor actuator slot.

8. The system according to claim 7, wherein an end portion of the positioning hook defines the lower portion of the visor actuator slot; and wherein the positioning hook is moveable to a user selected position within the visor actuator slot to define the lower portion of the visor actuator slot.

9. The system according to claim 8, further comprising a pivot member that engages a pivot through hole formed in a side portion of the helmet; wherein the pivot member is connected to a portion of the positioning hook; and wherein the positioning hook is rotatably moveable with respect to the pivot member.

10. The system according to claim 9, further comprising a lock screw that engages the positioning hook and is moveable within a lock screw slot; wherein the lock screw is moveable between a fixed position and an unfixed position; wherein the unfixed position of the lock screw allows the positioning hook to be rotatably moved within the visor actuator slot; and wherein the fixed position locks the position of the positioning hook within the visor actuator slot.

11. The system according to claim 3, wherein the first and the second visor carriers each include a first lever and a second lever to removably connect the first and second visor carriers to the visor lens; wherein the first lever is movable between a locked state and an unlocked state; and wherein the second lever is movable between a locked state and a released state.

12. A helmet visor system comprising:

a helmet shaped to accommodate a headset and having a visor actuator slot;

a first visor carrier and a second visor carrier each pivotally connected to the helmet;

a visor lens removably connected to the first visor carrier and the second visor carrier; and a visor apparatus carried by the helmet and connected to the visor lens;

an actuation knob extending through the visor actuator slot and attached to the first visor carrier;

wherein the actuation knob is movable between an upper portion of the visor actuator slot and a lower portion of the visor actuator slot;

wherein movement of the actuation knob to the upper portion of the visor actuator slot causes the visor lens to be pivotally moved to a stored position defined as the majority of the visor lens being occluded by the helmet;

wherein movement of the actuation knob to the lower portion of the visor actuator slot causes the visor lens to be pivotally moved to a deployed position defined as a majority of the visor lens being extended from the helmet;

wherein the visor lens is pivotally moveable between the stored position and the deployed position so as not to interfere with the headset; and wherein the visor lens being occluded by the helmet is defined as the visor lens being positioned within a helmet interior.

13. The system according to claim 12, wherein the actuation knob is moveable between an engaged position and a disengaged position when positioned in at least one of the upper portion and the lower portion of visor actuator slot; wherein when in the disengaged position, the actuation knob is moveable between the upper portion and the lower portion of the visor actuator slot; and wherein when in the engaged position, the actuation knob is fixed from movement between the upper portion and the lower portion of the visor actuator slot.

14. The system according to claim 13, wherein the actuation knob is movable between a stored locked position and a deployed locked position; wherein the stored locked position is defined as when the actuation knob is moved to the upper portion of the visor actuator slot and in the engaged position; and wherein the deployed lock position is defined as when the actuation knob is moved to the lower position of the visor actuator slot and in the engaged position.

15. The system according to claim 14, further comprising a knob lock spring to cause the actuation knob to move from the disengaged position to the engaged position.

16. The system according to claim 12, further comprising a positioning hook rotatably attached to the helmet and moveable within the visor actuator slot.

17. The system according to claim 16 wherein an end portion of the positioning hook defines the lower portion of the visor actuator slot; and wherein the positioning hook is moveable to a user selected position within the visor actuator slot to define the lower portion of the visor actuator slot.

18. The system according to claim 17, further comprising a pivot member that engages a pivot through hole formed in a side portion of the helmet; wherein the pivot member is connected to a portion of the positioning hook; and wherein the positioning hook is rotatably moveable with respect to the pivot member.

19. The system according to claim 18, further comprising a lock screw that engages the positioning hook and is moveable within a lock screw slot; wherein the lock screw is moveable between a fixed position and an unfixed position; wherein the unfixed position of the lock screw allows the positioning hook to be rotatably moved within the visor actuator slot; and wherein the fixed position locks the position of the positioning hook within the visor actuator slot.

20. The system according to claim 12, wherein the first and the second visor carriers each include a first lever and a second lever to removably connect the first and second visor carriers to the visor lens; wherein the first lever is movable between a locked state and an unlocked state; and wherein the second lever is movable between a locked state and a released state.

21. A helmet visor system comprising:

a helmet having a visor actuator slot;

a first visor carrier and a second visor carrier each pivotally connected to the helmet;

a visor lens removably connected to the first visor carrier and the second visor carrier;

a visor apparatus carried by the helmet and connected to the visor lens;

an actuation knob extending through the visor actuator slot and attached to the first visor carrier;

a positioning hook rotatably attached to the helmet and moveable within the visor actuator slot;

wherein an end portion of the positioning hook defines a lower portion of the visor actuator slot;

wherein the positioning hook is moveable to a user selected position within the visor actuator slot to define a lower portion of the visor actuator slot;

wherein the actuation knob is movable between the upper portion of the visor actuator slot and the lower portion of the visor actuator slot;

wherein movement of the actuation knob to the upper portion of the visor actuator slot causes the visor lens to be pivotally moved to a stored position; and wherein movement of the actuation knob to the lower portion of the visor actuator slot causes the visor lens to be pivotally moved to a deployed position.

22. The system according to claim 21, wherein the stored position is defined as the majority of the visor lens being occluded by the helmet; and wherein the deployed position is defined as a majority of the visor lens being extended from the helmet.

23. The system according to claim 22, wherein the helmet includes a helmet interior and a helmet exterior; and wherein the visor lens being occluded by the helmet is defined as the visor lens being positioned within the helmet interior.

24. The system according to claim 23, wherein the helmet is configured to accommodate a headset; and wherein the visor lens does not interfere with the headset when it is pivotally moved between the stored position and the deployed position.

25. The system according to claim 21, wherein the actuation knob is moveable between an engaged position and a disengaged position when positioned in at least one of the upper portion and the lower portion of visor actuator slot; wherein when in the disengaged position, the actuation knob is moveable between the upper portion and the lower portion of the visor actuator slot; and wherein when in the engaged position, the actuation knob is fixed from movement between the upper portion and the lower portion of the visor actuator slot.

26. The system according to claim 25, wherein the actuation knob is movable between a stored locked position and a deployed locked position; wherein the stored locked position is defined as when the actuation knob is moved to the upper portion of the visor actuator slot and in the engaged position; and wherein the deployed lock position is defined as when the actuation knob is moved to the lower position of the visor actuator slot and in the engaged position.

27. The system according to claim 26, further comprising a knob lock spring to cause the actuation knob to move from the disengaged position to the engaged position.

28. The system according to claim 21, further comprising a pivot member that engages a pivot through hole formed in a side portion of the helmet; wherein the pivot member is connected to a portion of the positioning hook; and wherein the positioning hook is rotatably moveable with respect to the pivot member.

29. The system according to claim 28, further comprising a lock screw that engages the positioning hook and is moveable within a lock screw slot; wherein the lock screw is moveable between a fixed position and an unfixed position; wherein the unfixed position of the lock screw allows the positioning hook to be rotatably moved within the visor actuator slot; and wherein the fixed position locks the position of the positioning hook within the visor actuator slot.

30. The system according to claim 21, wherein the first and the second visor carriers each include a first lever and a second lever to removably connect the first and second visor carriers to the visor lens; wherein the first lever is rotatably movable between a locked state and an unlocked state; and wherein the second lever is movable between a locked state and a released state.

* * * * *